US007771322B1

(12) United States Patent
Batca

(10) Patent No.: US 7,771,322 B1
(45) Date of Patent: Aug. 10, 2010

(54) FOLD AWAY WRIST ROLLER WITH SHARED CONSTANT TENSION LINE

(76) Inventor: Roger Batca, 3102 Shaftsbury St., Durham, NC (US) 27704

( * ) Notice: Subject to any disclaimer, the term of this patent is extended or adjusted under 35 U.S.C. 154(b) by 0 days.

(21) Appl. No.: 12/402,802

(22) Filed: Mar. 12, 2009

Related U.S. Application Data

(60) Provisional application No. 61/069,695, filed on Mar. 17, 2008.

(51) Int. Cl.
*A63B 23/04* (2006.01)
*A63B 23/14* (2006.01)
*A63B 21/062* (2006.01)

(52) U.S. Cl. ..... 482/46; 482/100; 482/137; 482/138; 482/142

(58) Field of Classification Search ..... 482/44–46, 482/49, 50, 92–94, 97–103, 133–139, 142
See application file for complete search history.

(56) References Cited

U.S. PATENT DOCUMENTS

| | | | | |
|---|---|---|---|---|
| 4,072,308 | A * | 2/1978 | Applegate | 482/94 |
| 4,183,520 | A * | 1/1980 | Chase | 482/112 |
| 4,606,540 | A * | 8/1986 | Chin-Sen | 482/98 |
| 4,678,185 | A * | 7/1987 | Mahnke | 482/137 |
| 4,793,608 | A * | 12/1988 | Mahnke et al. | 482/98 |
| D301,597 | S * | 6/1989 | Lehtonen | D21/675 |
| D303,558 | S * | 9/1989 | Alessandri | D21/675 |
| 4,979,734 | A * | 12/1990 | Sims | 482/112 |
| 5,002,271 | A * | 3/1991 | Gonzales | 482/130 |
| 5,716,308 | A * | 2/1998 | Lee | 482/130 |
| 5,961,428 | A * | 10/1999 | Webber | 482/100 |
| 6,319,178 | B1 * | 11/2001 | Webber | 482/100 |
| 6,595,905 | B2 * | 7/2003 | McBride | 482/130 |
| 7,172,537 | B2 * | 2/2007 | Eisa | 482/138 |
| 7,223,216 | B1 * | 5/2007 | McBride | 482/121 |
| 7,276,018 | B2 * | 10/2007 | Studdard | 482/142 |
| 2004/0009856 | A1 * | 1/2004 | Hammer | 482/99 |
| 2004/0033871 | A1 * | 2/2004 | Ma | 482/142 |
| 2006/0189462 | A1 * | 8/2006 | Pearson et al. | 482/142 |

(Continued)

FOREIGN PATENT DOCUMENTS

| | | | |
|---|---|---|---|
| EP | 614683 | A1 * | 9/1994 |

(Continued)

*Primary Examiner*—Loan H Thanh
*Assistant Examiner*—Victor K Hwang
(74) *Attorney, Agent, or Firm*—Coats & Bennett, P.L.L.C.

(57) ABSTRACT

An exercise apparatus includes a leg exercise arm assembly pivotally attached to a frame or user support assembly. A user can perform leg extension exercises and/or leg curl exercises with the leg exercise arm assembly. The exercise apparatus also includes a wrist roller assembly that is also pivotally attached to the user support assembly, frame, or leg exercise arm assembly. The wrist roller assembly can be locked into a first position that allows the user to perform leg extension and leg curl exercises without interference from the wrist roller assembly and a second position that allows a user to perform wrist rolling exercises. A flexible line interconnects the leg exercise arm assembly with the wrist roller assembly as well as connecting the leg exercise arm assembly and the wrist roller assembly directly or indirectly with a resistance element. The flexible line maintains a substantially constant tension whether the wrist roller assembly is locked into a first position or into a second position.

20 Claims, 32 Drawing Sheets

U.S. PATENT DOCUMENTS

2006/0258517 A1* 11/2006 Ashley ..... 482/94
2008/0090710 A1* 4/2008 Chung ..... 482/142
2010/0016129 A1* 1/2010 Chou ..... 482/97

FOREIGN PATENT DOCUMENTS

GB 2352643 A * 2/2001
RU 2069579 C1 * 11/1996
SU 1720666 A1 * 3/1992

* cited by examiner

FOLD AWAY WRIST ROLLER WITH SHARED CONSTANT TENSION LINE

RELATED APPLICATIONS

This application claims priority to Provisional Patent Application No. 61/069,695 filed Mar. 17, 2008, which is incorporated herein by reference.

FIELD OF THE INVENTION

The present invention is directed generally to exercise equipment and, more particularly, an apparatus to perform leg exercises and wrist rolling exercises.

BACKGROUND

Various types of exercise machines for strengthening and conditioning the body are known. One group of exercise machines are categorized as multi station gyms. Multi station gyms combine multiple exercise stations onto one frame, typically sharing one user support seat, in order to save space and cost. Also, most multi station gyms typically have one resistance source shared by all the stations to further save cost. The resistance source is usually a weight stack wherein a cable system interconnects all the exercise stations to the weight stack. Since all the exercise stations share the same frame and typically the same resistance source, the exercise stations will be close to one another and must cooperatively work with one another wherein the exercise movement of one station will not interfere with the movement of another exercise station. A properly designed multi station gym will also allow the user to properly position their self to perform each exercise without interference from any of the unused stations.

One common design of a multi station gym consists of a user support bottom seat and back seat near the front of the gym and a weight stack near the back of the gym. This common design also includes a high pull station above the user support seating, a vertical pressing station just below the high pull station, a mid section free cable end to pull just above and behind the seating for performing abdominal crunches, and a leg extension/leg curl station in front of the user seating. To use the high pull down station, the user pulls down one or two free cables to exercise the back, bicep, and triceps muscles. To use the pressing station, the user presses one or two arms outward to exercise the chest muscles. To use the mid section free cable, the user attaches an abdominal crunch strap to the free cable and performs abdominal crunches to exercise the abdominal muscles. To use the leg extension station, the user sits in the seat and puts their knees over an upper pad assembly and their ankles behind a lower pad assembly and performs extensions to exercise the thigh muscles. To use the leg curl station, the user adjusts the upper pad assembly above the leg extension/curl arm assembly pivot point in order to brace their leg just above their knee while facing the gym. The user then aligns their knee with the leg extension/curl arm assembly pivot point and places their ankle behind the lower pad assembly and performs standing leg curls to exercise the hamstring muscles. The combined stations allow the user to exercise their chest, back, upper arms, abdominal muscles, and legs. However, this compact design does not include an effective way to isolate and exercise the forearm muscles.

A known type of exercise apparatus to effectively isolate and exercise the forearms is a wrist rolling apparatus. A wrist rolling apparatus typically has a handle bar attached to a frame wherein a flexible line is connected at one end to the handle bar and wherein the other end is connected to resistance. To exercise the forearm muscles, a user will grasp the handle bar and roll their wrist forward or backwards wherein the handle bar will rotate on the frame in order to wrap the flexible line around the handle bar which will displace the resistance element and provide resistance.

It would be desirable for a multi station gym design to include a wrist rolling assembly wherein a user could effectively isolate and exercise their forearms. It would also be desirable to add the wrist roller assembly by minimally changing the compact size of the gym and by sharing the existing frame. It would also be desirable to add the wrist roller assembly to the gym wherein the user's movement and position while exercising with one station would not interfere with the user's movement and position while exercising with another station. It would also be desirable to add the wrist rolling assembly without adding an additional cable to the cable system which would add extra cable stretch and cable bounce, and negatively affect the performance of the exercise stations.

SUMMARY

The present invention is an exercise apparatus which includes a leg exercise assembly and a wrist rolling assembly. The leg exercise assembly and wrist rolling assembly cooperatively work in tandem wherein the wrist rolling assembly is locked into a first storage position which allows the user to perform leg extension and leg curl exercises without interference from the wrist rolling assembly. The wrist rolling assembly can be adjusted to a second position wherein wrist rolling exercises can be performed. The exercise apparatus comprises a frame, a resistance element, and in one exemplary embodiment, a leg exercise arm assembly and a wrist rolling assembly pivotally attached to the frame wherein a flexible connecting line and pulley system connects the leg exercise arm assembly and wrist rolling assembly to the resistance element.

In another aspect of the invention, a single flexible line within the flexible line connecting system interconnects the leg exercise arm assembly and the wrist rolling assembly with the resistance element wherein a substantially constant tension is maintained on the flexible line connecting system whether the wrist rolling assembly is in a first storage position or a second in use position.

In an alternate embodiment, the leg exercise arm assembly is pivotally attached to the frame and the wrist rolling assembly is pivotally attached to the leg exercise arm assembly. As in the previous embodiment, a single flexible line within the flexible line connecting system interconnects the leg exercise arm assembly and the wrist rolling assembly with the resistance element wherein a substantially constant tension is maintained on the flexible line connecting system whether the wrist rolling assembly is in a first storage position or a second in use position.

Other aspects of the invention will become apparent in the detailed description.

DETAILED DESCRIPTION

Figure 1:
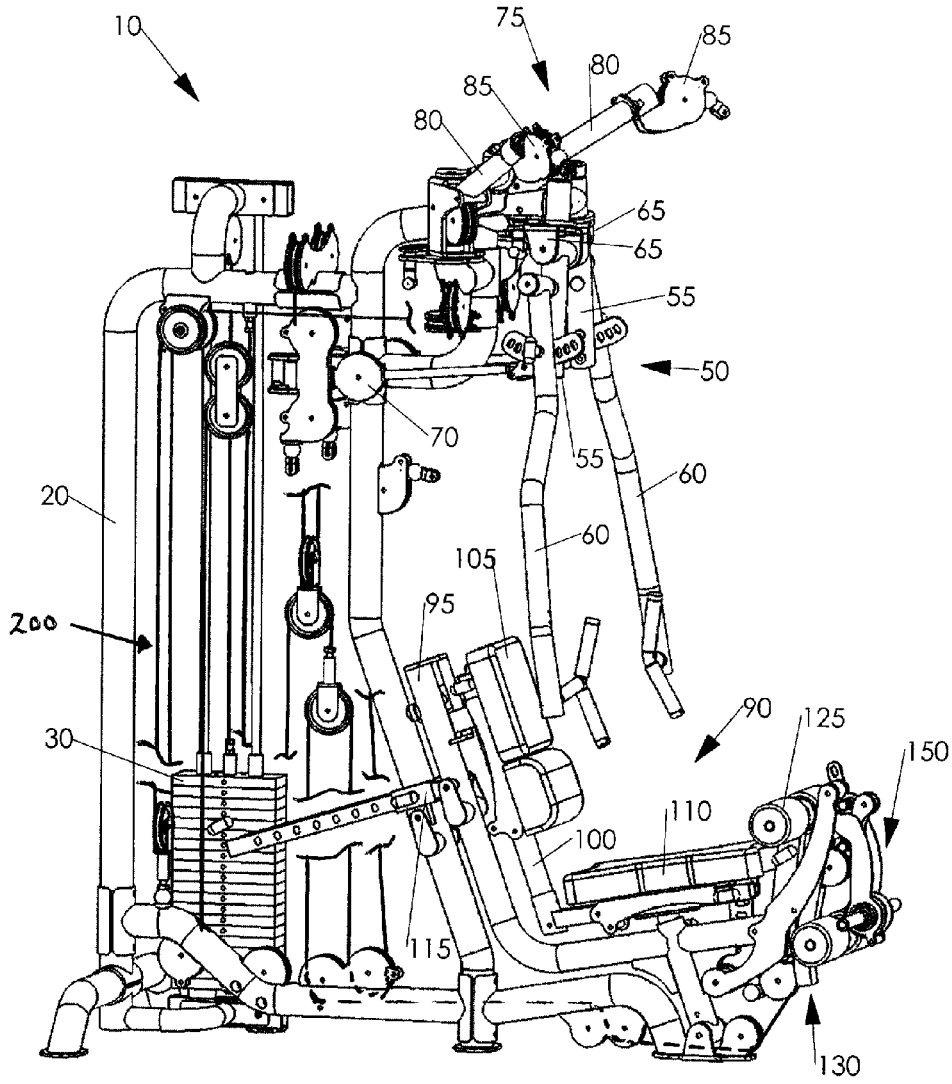
FIG. 1 is a perspective view illustrating an exemplary exercise apparatus from the front right side wherein the leg exercise arm assembly is in a start position and the wrist roller assembly is in a stored first position.
Figure 1:
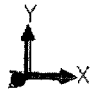

Referring now to the drawings, an exercise apparatus according to the present invention is shown therein and indicated generally by the numeral 10. The exercise apparatus 10 comprises a frame 20, weight stack 30 or other resistance element, arm assembly 50, adjustable width high pull down assembly 75, user support assembly 90, a leg exercise arm assembly 130, 230, 330, a wrist roller assembly 150, 250, 350, and a flexible line connecting system 200 interconnecting the arm assembly 50, adjustable width high pull down assembly 75, leg exercise arm assembly 130, and wrist roller assembly 150 to the resistance element 30. The exemplary embodiment shown in the drawings is for performing chest press exercises, mid row exercises, high pull down exercises, leg extension exercises, leg curl exercises, and wrist rolling exercises. In the exemplary embodiment, the flexible line connecting system 200 is a cable and pulley system. A cable and pulley system with a similar configuration is described in more detail in U.S. patent application Ser. No. 11/763,509 wherein Roger Batca is the inventor. Those skilled in the art would appreciate that other flexible lines such as belts, straps, chains, ropes, or cords could be used to carry out the present invention. Also, those skilled in the art would appreciate that there are numerous configurations of cables and pulleys that could be used to carry out the present invention.

As illustrated in FIGS. 1-4, the frame 20 provides structural support and stability to the exercise apparatus 10. The frame 20 also provides connection points for the resistance element 30, arm assembly 50, adjustable width high pull down assembly 75, user support assembly 90, leg exercise arm assembly 130, wrist roller assembly 150, and pulleys within cable and pulley system 200.

As illustrated in FIGS. 1-4, in the exemplary embodiment, the resistance element 30 is a weight stack. Weight stacks are commonly used as a resistance element in the art of strength training. Those skilled in the art will appreciate that other resistance devices, such as electronic resistance devices, magnetic breaks, hydraulic cylinders, elastic bands, free weights, or pneumatic resistance may also be used to practice the present invention.

As illustrated in FIGS. 1-4, the arm assembly 50 includes respective first arm sections 55 pivotally attached to respective swivel assemblies 65. The swivel assemblies 65 are pivotally attached to the frame 20. The arm assembly 50 also includes respective second arm sections 60 which are pivotally attached to respective first arm sections 55. A respective pulley assembly 70 is pivotally attached to a respective first arm section 55 and interconnects the arm assembly 50 with the weight stack 30 by way of cable and pulley system 200. A two axis arm assembly with similar components is described in more detail in U.S. patent application Ser. Nos. 11/254,576 and 11/346,528 and 11/584,327 wherein Roger Batca is the inventor.

As illustrated in FIGS. 1-4, the adjustable width high pull down assembly 75 includes respective arm extensions 80 that are pivotally attached to frame 20 and are width adjustable. Respective swivel pulley assemblies 85 are pivotally attached at the distal end of each respective arm extension 80. A respective cable end exits a respective swivel pulley assembly 85 wherein a handle assembly 90 can be attached. An adjustable width high pull down assembly with similar components is described in more detail in U.S. patent application Ser. No. 11/763,509 wherein Roger Batca is the inventor.

As illustrated in FIGS. 1-8, the frame 20 may include a user support assembly 90. The user support assembly 90 includes a seat main frame 95, a seat sub frame 100, a back seat assembly 105, a bottom seat assembly 110, an upper pad assembly 125, a leg exercise arm assembly 130, and a wrist roller assembly 150. The user support assembly 90 also includes adjustment mechanism 115 to adjust the user support assembly 90 to various locations to support the user for various exercises.

Figure 5:
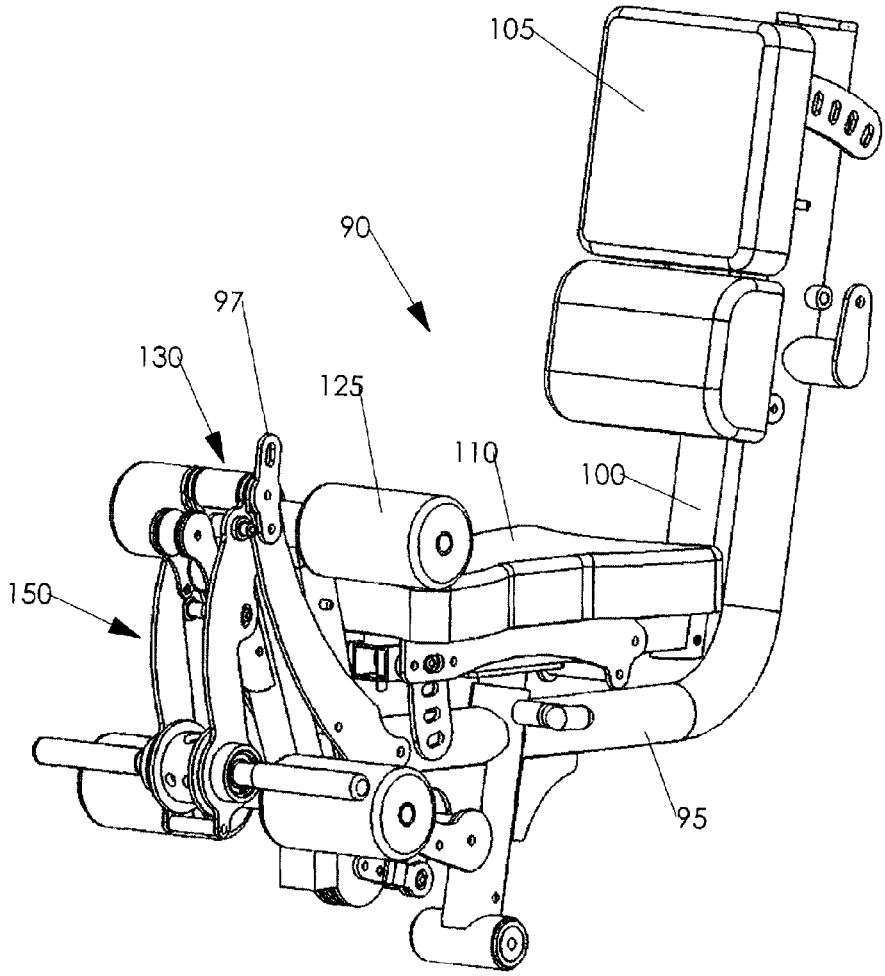
FIG. 5 is a perspective view illustrating an exemplary user support assembly from the front left side wherein the leg exercise arm assembly is in a start position and the wrist roller assembly is in a stored first position.
Figure 5:
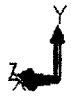
Figure 6:
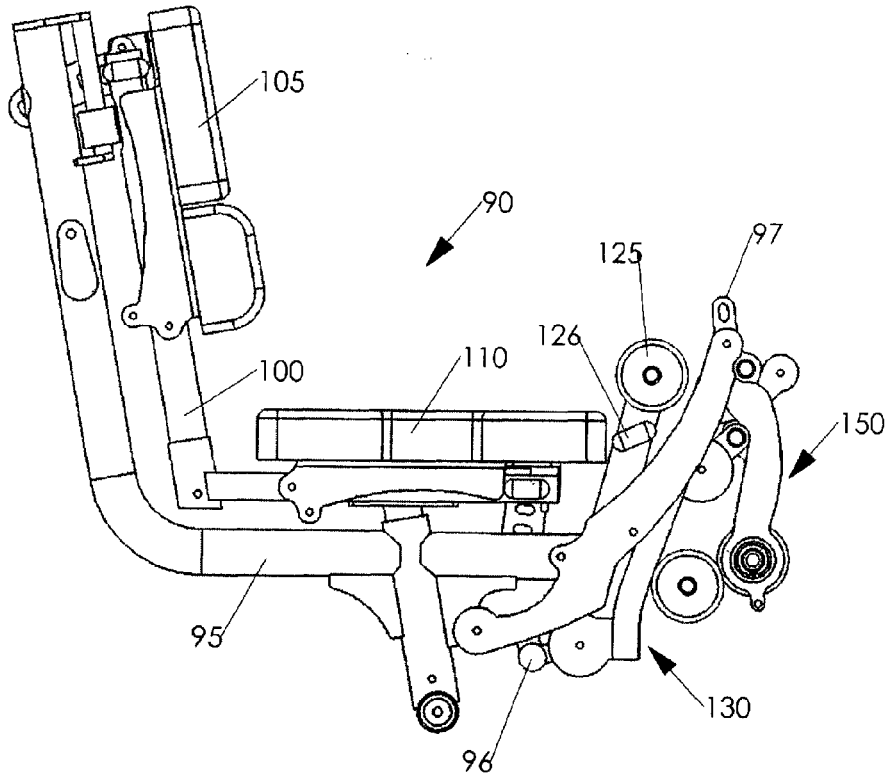
FIG. 6 is a side view illustrating an exemplary user support assembly wherein the leg exercise arm assembly is in a start position and the wrist roller assembly is in a stored first position.
Figure 6:
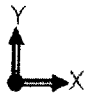
Figure 12:
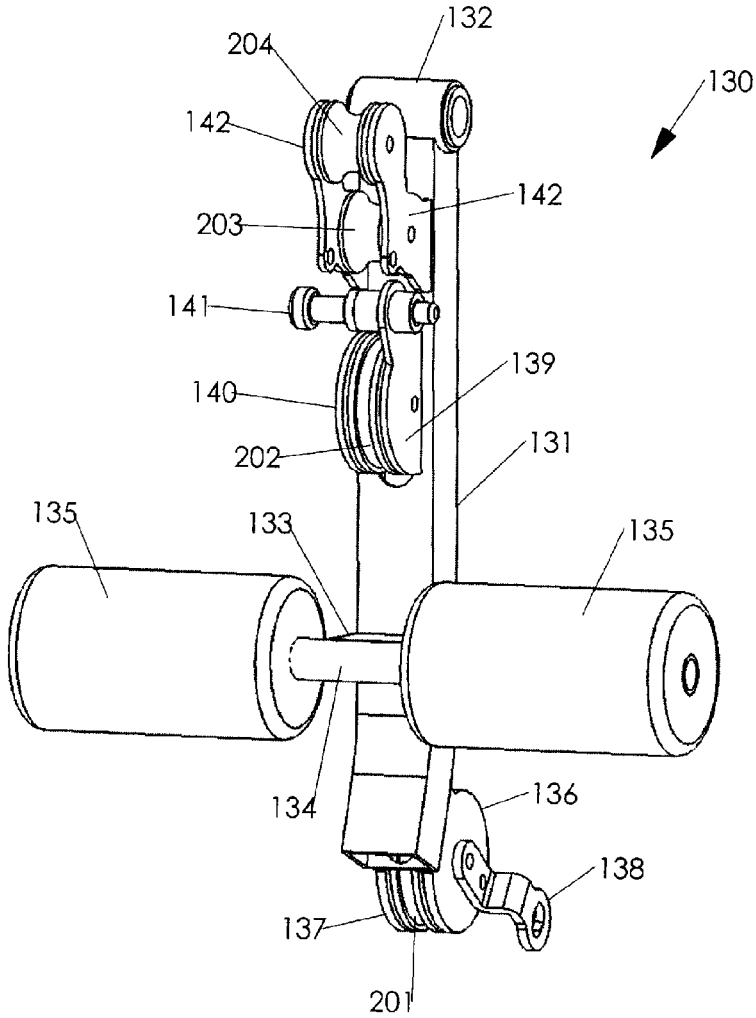
FIG. 12 is a perspective view illustrating an exemplary leg exercise arm assembly from the front left side.
Figure 12:
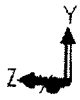

The exemplary leg exercise arm 130 is illustrated in FIG. 12 and includes extension tube 131 wherein bushing tube 132 is attached at one end. Pulley plates 136 and 137 are attached near the opposite end and secure pulley 201 of cable and pulley system 200. Aperture plate 138 is attached to pulley plate 136 and as best illustrated in FIGS. 5 and 6, provides an aperture for locking pin 96 on seat main frame 95 to lock into to secure leg exercise arm 130 into a stationary position when leg extension or leg curl exercises are not being performed by a user. Locking pin 96 is adjusted to an unlocked position when leg extension and leg curl exercises are being performed.

Leg exercise arm 130 further includes pulley plates 139 and 140 which secure pulley 202 of cable and pulley system 200, and pulley plates 142 which secure pulleys 203 and 204 of cable and pulley system 200. Locking pin 141 is attached to pulley plate 139 and secures wrist roller assembly 150 into a first position for storage as best illustrated in FIG. 5. Lower pad extension tube 133 and lower pad tube 134 are attached to extension tube 131 and secure lower pads 135.

Figure 7:
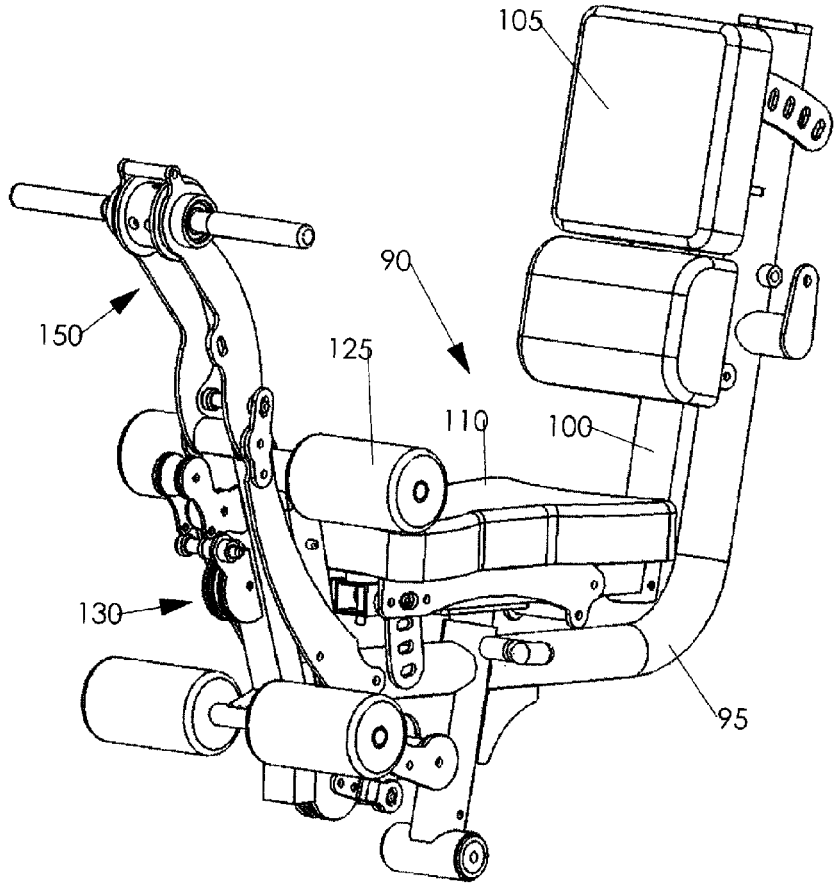
FIG. 7 is a perspective view illustrating an exemplary user support assembly from the front left side wherein the leg exercise arm assembly is in a start position and the wrist roller assembly is in a use second position.
Figure 7:
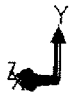
Figure 11:
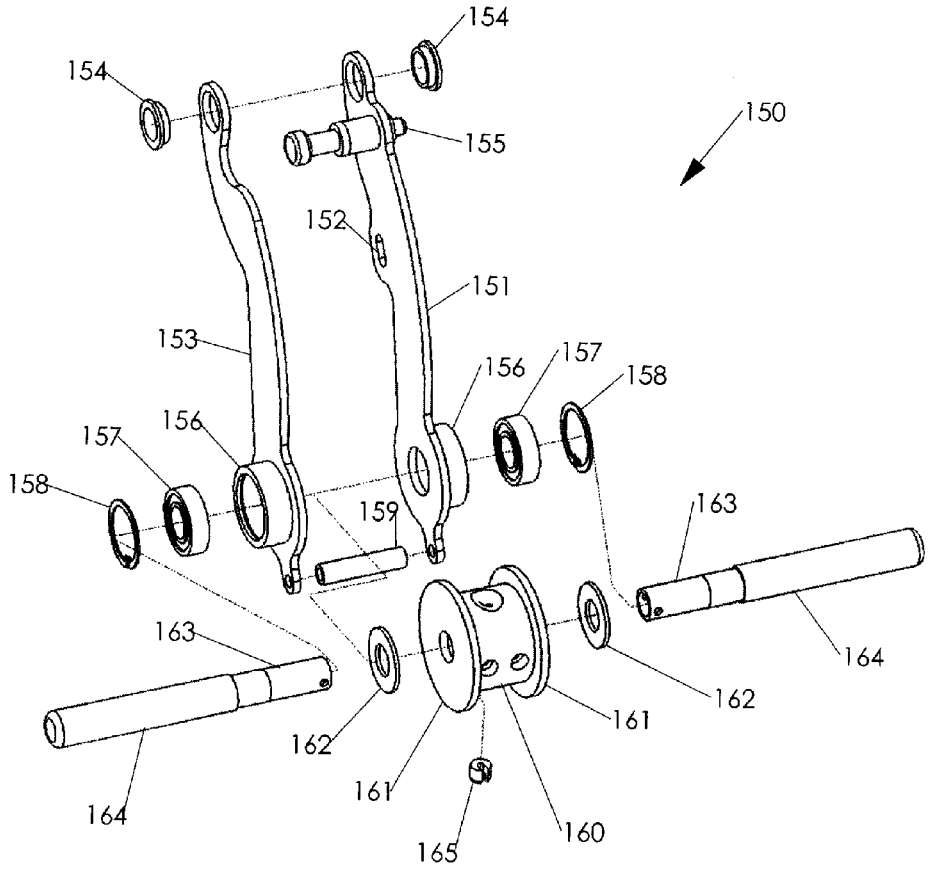
FIG. 11 is an exploded perspective view illustrating an exemplary wrist roller assembly from the front right side.
Figure 11:
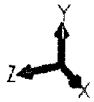

The exemplary wrist roller assembly 150 is illustrated in FIG. 11 and includes side plate 151 wherein bushing 154 is attached near one end and bearing sleeve 156 is attached near the other end. Bearing 157 fits into bearing sleeve 156 and is secured by snap ring 158. Locking pin 155 is attached to side plate 151 and locks into aperture plate 97 of seat main frame 95 and secures wrist roller assembly 150 into a second position for use as best illustrated in FIG. 7. Wrist roller assembly further includes side plate 153 wherein bushing 154 is attached near one end and bearing sleeve 156 is attached near the other end. Bearing 157 fits into bearing sleeve 156 and is secured by snap ring 158. Spacer 159 attaches in between side plates 151 and 153 and provides proper spacing. Flexible line reel 160 fits in between side plates 151 and 153 and provides a surface for a flexible line to wrap around, wherein side plates 161 retain a flexible line as wrist rolling exercises are being performed. Flexible line reel 160 also includes an aperture for a flexible line to go through wherein retainer 165 secures the flexible line. Respective handle bars 163 along with respective grips 164 go through respective bearings 157 of side plates 151 and 153, through respective bushings 162, and are secured inside of flexible line reel 160.

Figure 10:
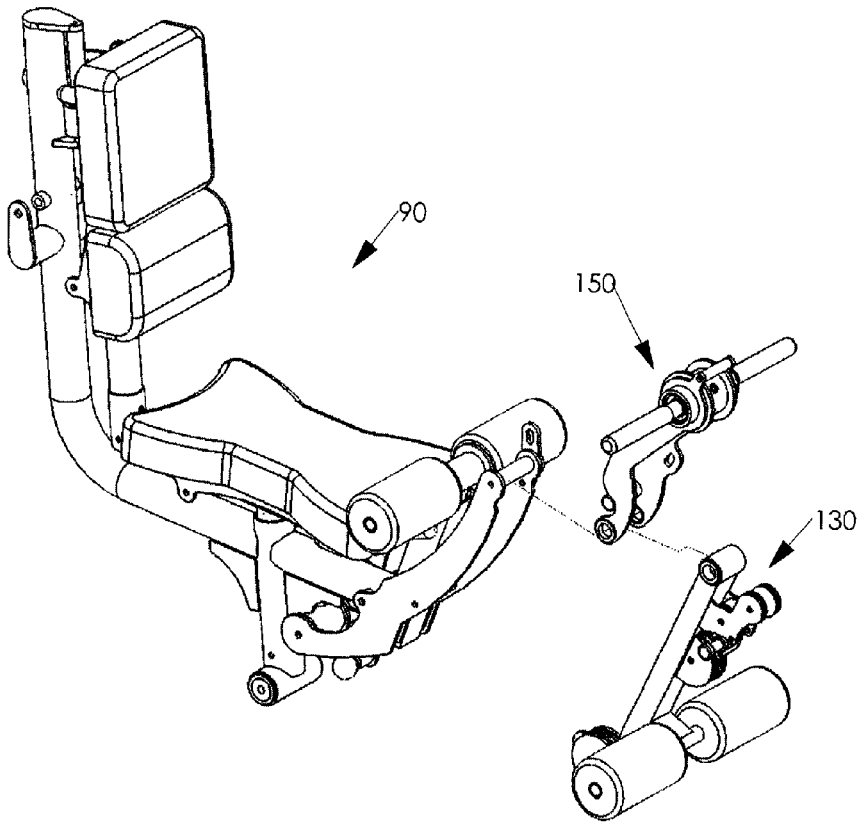
FIG. 10 is an exploded perspective view illustrating an exemplary user support assembly, a leg exercise arm assembly, and a wrist roller assembly from the front right side.
Figure 10:
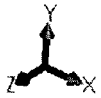

FIG. 10 is an exploded view illustrating the above mentioned exemplary leg exercise arm assembly 130 and exemplary wrist roller assembly 150 detached from the user support assembly 90.

FIG. 1 illustrates exercise apparatus 10 wherein the wrist roller assembly 150 is in a locked first position in storage. A user could exercise with arm assembly 50 to perform chest press exercises on exercise apparatus 10 without interference from the wrist roller assembly 150 while in this first position in storage. A user could exercise with the adjustable width high pull down assembly 75 to perform high pull down exercises on exercise apparatus 10 without interference from the wrist roller assembly 150 while in this first position in storage. FIGS. 5 and 6 also illustrate the user support assembly 90, the leg exercise arm assembly 130, and the wrist roller assembly 150 wherein the wrist roller assembly 150 is locked into the leg exercise arm assembly 130 into a first position in storage.

Figure 3:
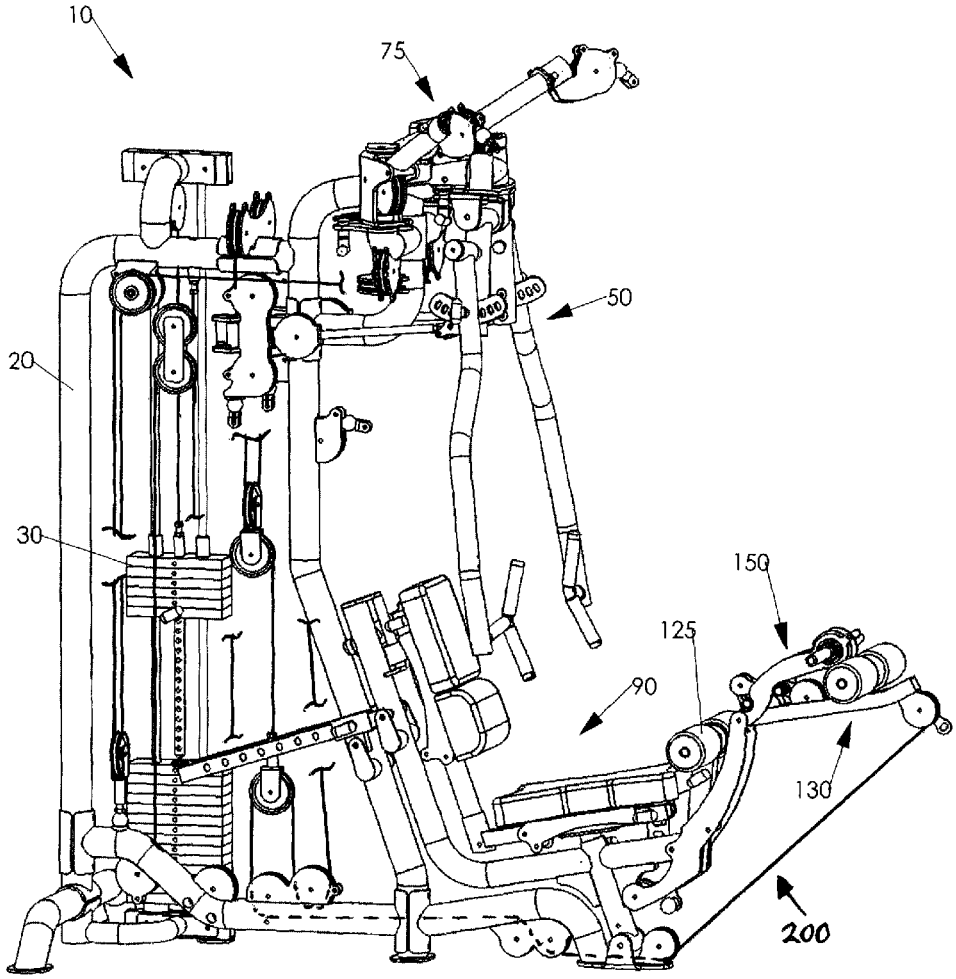
FIG. 3 is a perspective view illustrating an exemplary exercise apparatus from the front right side wherein the leg exercise arm assembly is in a finish position and the wrist roller assembly is in a stored first position.
Figure 3:
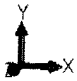

FIG. 3 illustrates exercise apparatus 10 wherein the wrist roller assembly 150 is in a locked first position in storage and wherein the leg exercise arm assembly 130 is in an extended finish position wherein a user would be performing a leg extension exercise. In this exemplary embodiment, the leg exercise arm assembly 130 and the wrist roller assembly 150 are both pivotally attached to the seat main frame 95 and share the same pivot axis, therefore the wrist roller assembly 150 pivots along with leg exercise arm assembly 130 during leg extension exercises. To perform leg extension exercise, the user would select the desired amount of resistance from weight stack 30, sit on user seat support 90, place their legs just underneath their knees over upper pad assembly 125, and their lower legs near their ankles behind lower pads 135 of leg exercise arm assembly 130. The user would then extend their legs back and forth for the desired number of repetitions. The wrist roller assembly 150 in this locked first position in storage does not interfere with the user's legs or feet during leg extension exercises.

Figure 2:
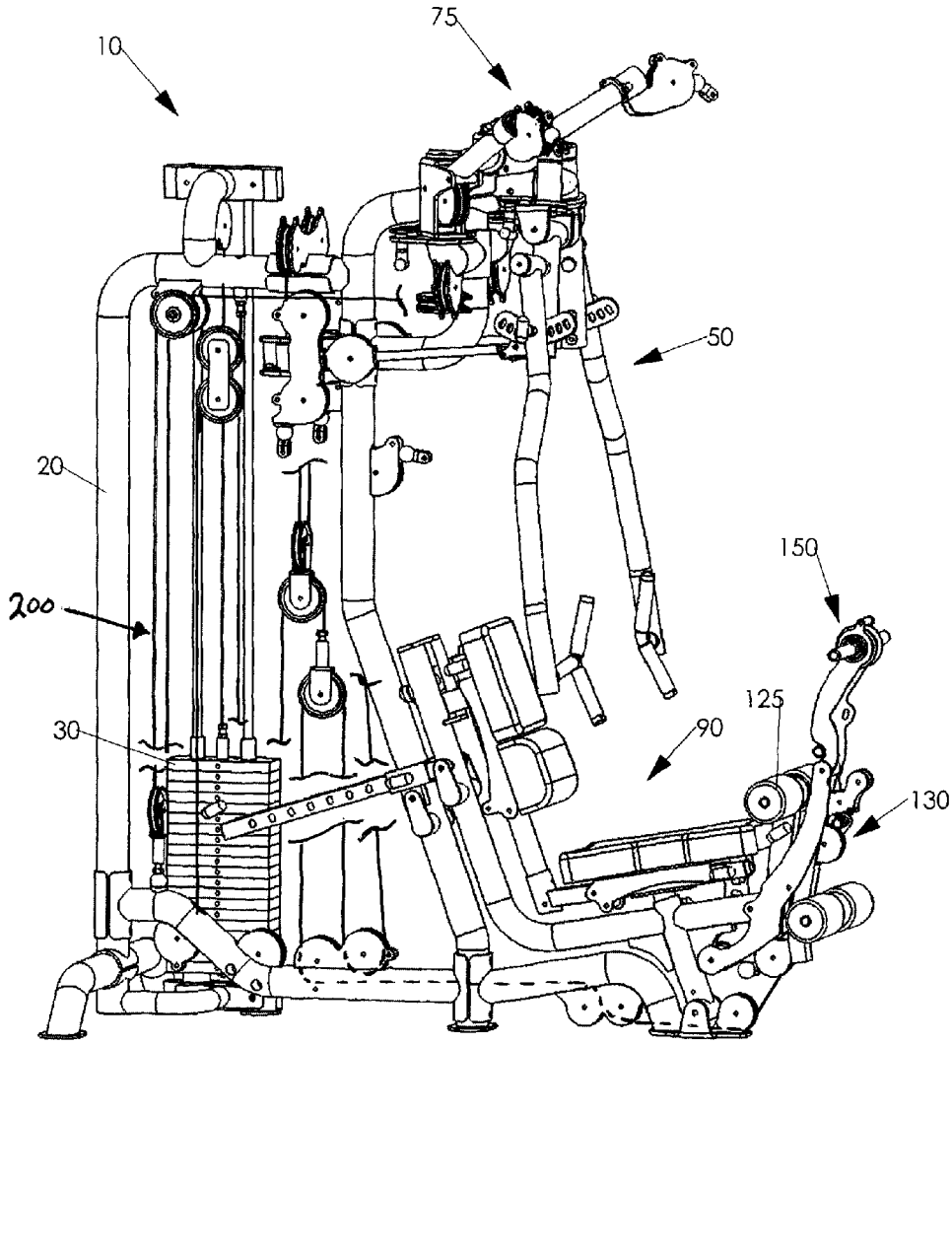
FIG. 2 is a perspective view illustrating an exemplary exercise apparatus from the front right side wherein the leg exercise arm assembly is in a start position and the wrist roller assembly is in a use second position.
Figure 4:
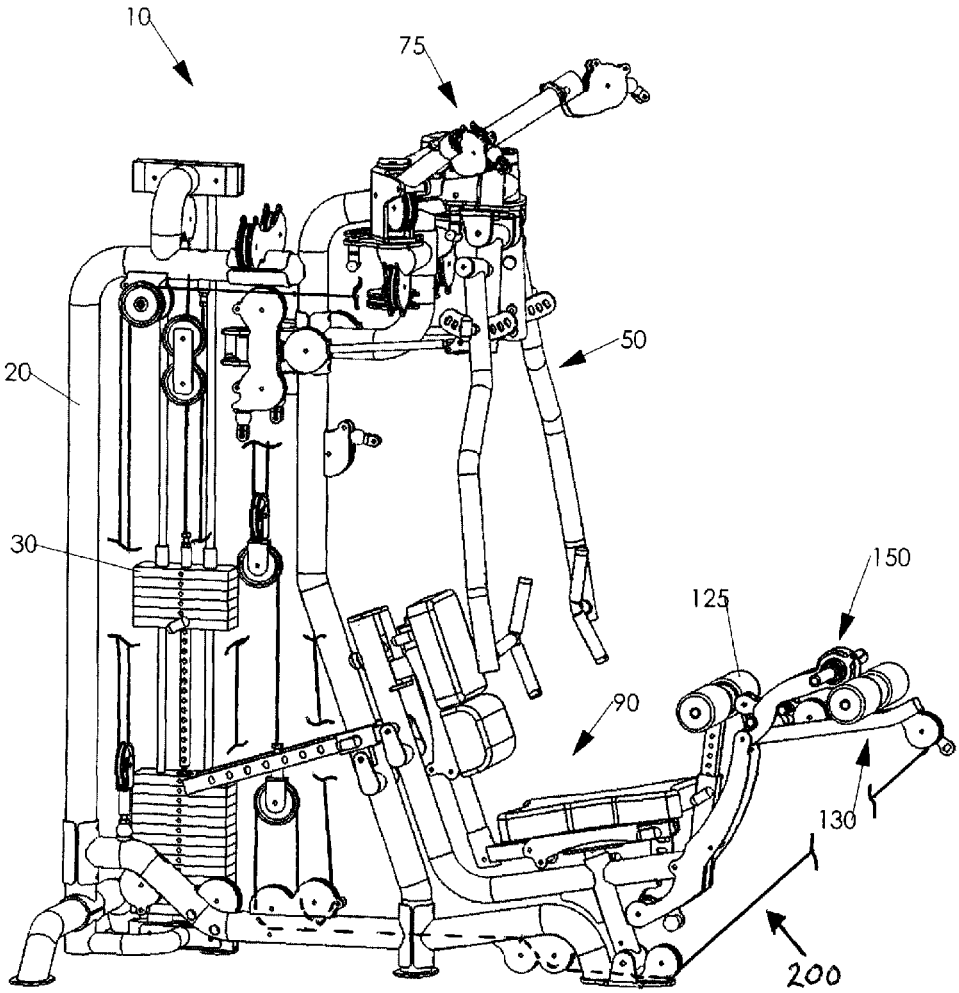
FIG. 4 is a perspective view illustrating an exemplary exercise apparatus from the front right side wherein the leg exercise arm assembly is in a finish position and the wrist roller assembly is in a stored first position.
Figure 4:
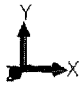

FIG. 4 illustrates exercise apparatus 10 wherein the wrist roller assembly 150 is in a locked first position in storage and wherein the leg exercise arm assembly 130 is in an extended finish position wherein a user would be performing a leg curl exercise. In this exemplary embodiment, the leg exercise arm assembly 130 and the wrist roller assembly 150 are both pivotally attached to the seat main frame 95 and share the same pivot axis, therefore the wrist roller assembly 150 pivots along with leg exercise arm assembly 130 during leg curl exercises. To perform leg curl exercise, the user would select the desired amount of resistance from weight stack 30, stand in front facing user seat support 90, adjust the upper pad assembly 125 wherein the pads are above the pivot axis of leg exercise arm assembly 130 and wrist roller assembly 150, brace the front of one of their legs just above their knee against upper pad assembly 125, and brace the same leg near their ankle behind a respective lower pad 135 of leg exercise arm assembly 130. The user would then curl their leg back and forth for the desired number of repetitions. The wrist roller assembly 150 in this locked first position in storage does not interfere with the user's legs or feet during leg curl exercises. The user could lock wrist roller 150 into a second position as shown in FIG. 2 and use the wrist roller as a brace to help stabilize the body while performing leg curl exercises. The wrist roller assembly 150 in this locked second position would not interfere with the user's legs or feet during leg curl exercises.

Figure 8:
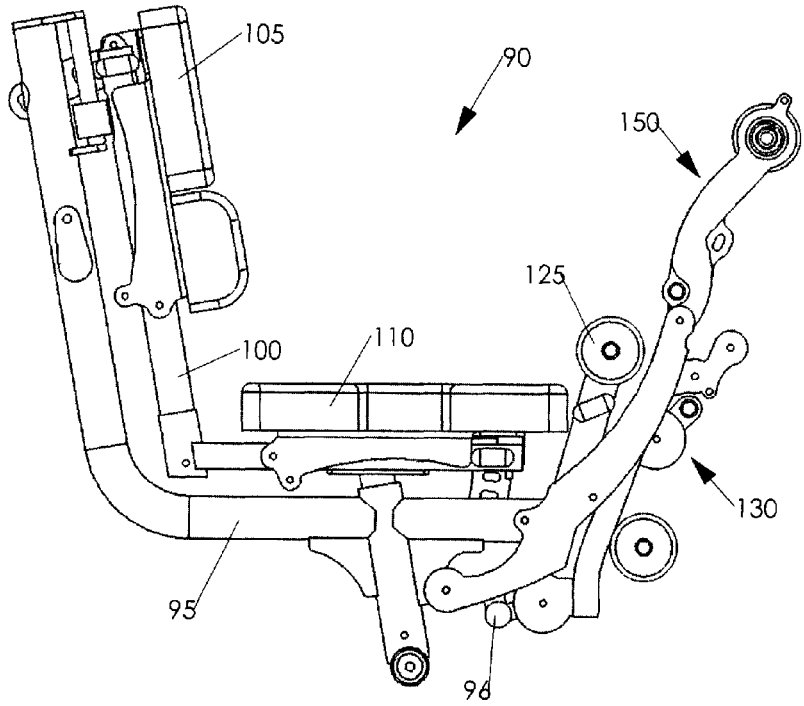
FIG. 8 is a side view illustrating an exemplary user support assembly wherein the leg exercise arm assembly is in a start position and the wrist roller assembly is in a use second position.
Figure 8:
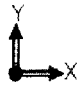

FIG. 2 illustrates exercise apparatus 10 wherein the wrist roller assembly 150 is in a locked second position in use. FIGS. 7 and 8 also illustrate the user support assembly 90, the leg exercise arm assembly 130, and the wrist roller assembly 150 wherein the wrist roller assembly 150 is locked into the seat main frame 95 into a second position in use. To perform wrist rolling exercise, the user would select the desired amount of resistance from weight stack 30. The user could sit on user support assembly 90 and be in a seated position to perform wrist rolling exercise or the user could straddle user support assembly 90 or stand in front of user support assembly 90 to perform wrist rolling exercise. Once the seated or standing position is selected, the user would then grasp grips 164 on handle bars 163 and then begin to roll their wrists forwards or backwards, thus rotating the flexible line reel 160 wherein a flexible line within flexible line connecting system 200 will wrap around flexible line reel 160 and displace weight stack 30. Once finished performing wrist rolling exercises, the user can unlock locking pin 155 of wrist roller assembly 150 and pivot wrist roller assembly 150 downward and lock it into the above described first position in storage wherein locking pin 141 of leg exercise arm assembly 130 secures wrist roller assembly 150 to the leg exercise arm assembly 130. When locked into the first position in storage, the wrist roller assembly 150 will not interfere with any other exercise movements or positions of the user on exercise apparatus 10.

Figure 9:
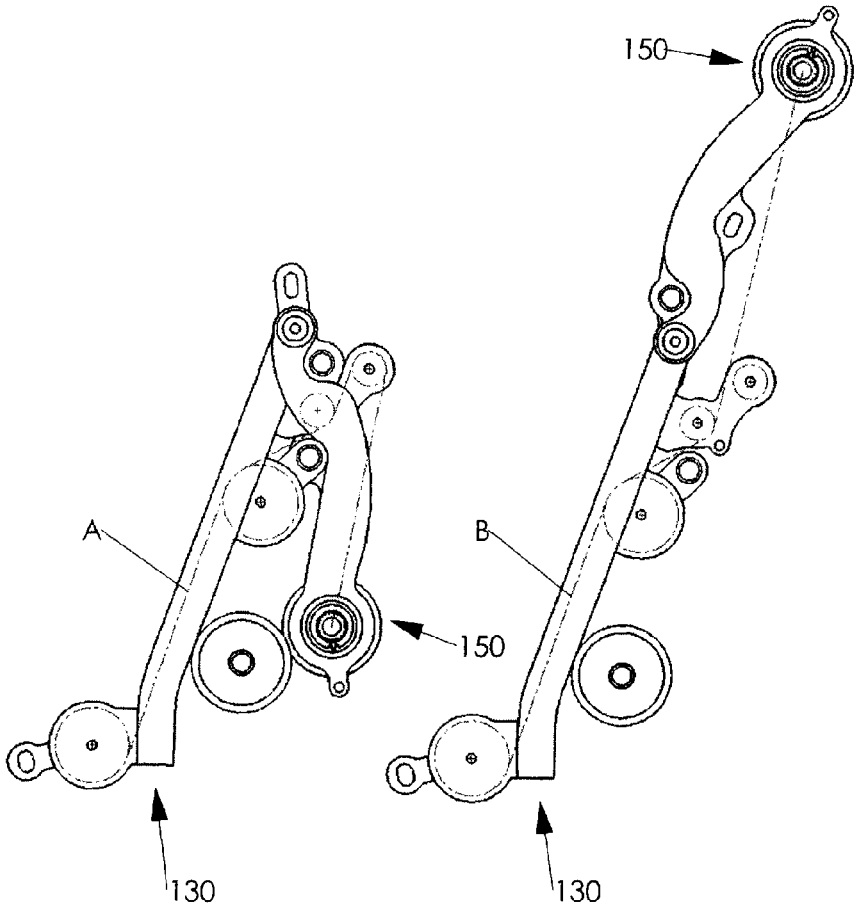
FIG. 9 is a side view illustrating the flexible line routing of an exemplary leg exercise arm assembly in a start position and an exemplary wrist roller assembly in a stored first position as well as a use second position.
Figure 9:
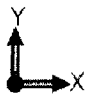

FIG. 9 illustrates a wrist roller assembly 150 pivotally attached to a leg exercise arm assembly 130 and locked into a first position in storage and a wrist roller assembly 150 pivotally attached to a leg exercise arm assembly 130 and locked into a second position in use. The flexible line routing is illustrated for both locked positions. The illustration of the flexible line routing wherein the wrist roller assembly 150 is locked into a first position in storage begins near the bottom of leg exercise arm assembly 130 with pulley 201 and is labeled with the letter A. The flexible line then travels upward and partially wraps over pulley 202. The flexible line then travels upward and partially wraps under pulley 203. The flexible line then travels upward and wraps over pulley 204 and then back downward and connects to wrist roller assembly 150.

The illustration of the flexible line routing wherein the wrist roller assembly 150 is locked into a second position in use begins near the bottom of leg exercise arm assembly 130 with pulley 201 and is labeled with the letter B. The flexible line then travels upward and partially wraps over pulley 202. The flexible line then travels upward and partially wraps under pulley 203. The flexible line continues to travel upward and connects to wrist roller assembly 150.

The portion of flexible line A that wraps partially around the circumference of pulley 204 when the wrist roller assembly 150 is locked in the first position in storage is equal to the offset height differential of the wrist roller assembly 150 pivot axis from pulley 204. Therefore, because flexible line B bypasses pulley 204 and is connected directly into wrist roller assembly 150 when the wrist roller assembly 150 is locked in the second position in use, the length of flexible line A is equal to the length of flexible line B. Since the portion of the flexible line interconnecting the leg exercise arm assembly 130 with the wrist roller assembly 150 maintains a substantially equal length whether the wrist roller assembly 150 is locked into a first position in storage or locked into a second position in use, the flexible line connecting system 200 will also maintain a substantially constant tension whether the wrist roller assembly 150 is locked into a first position in storage or locked into a second position in use.

Figure 13:
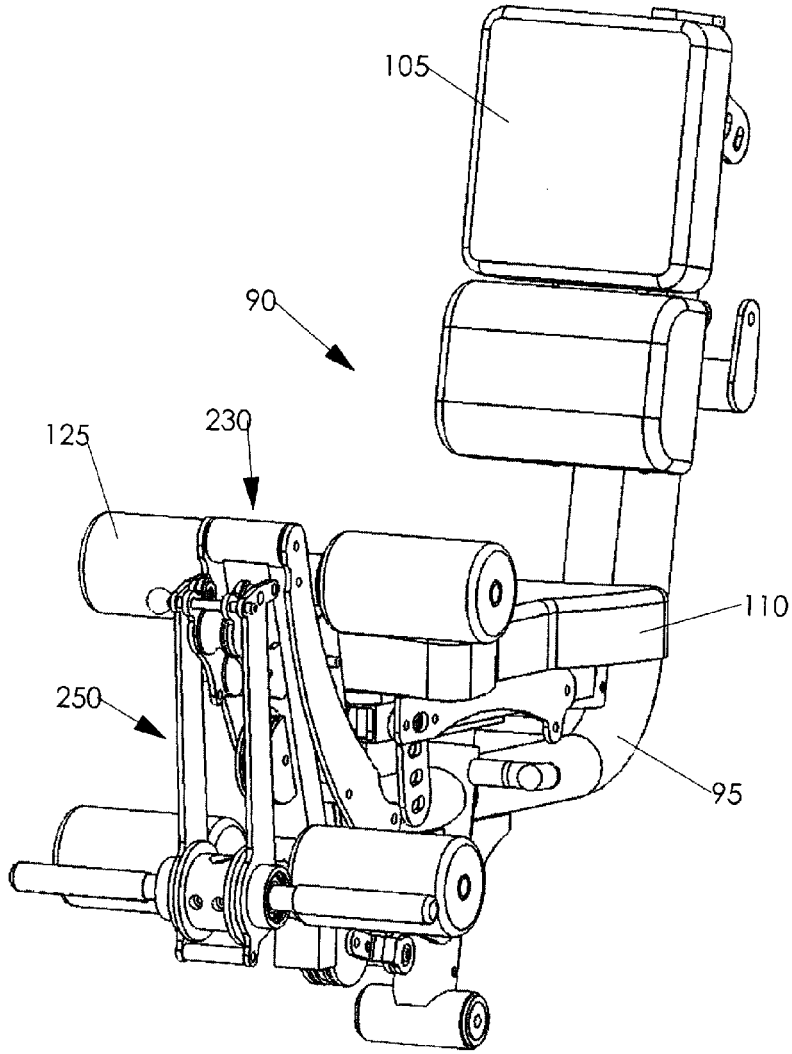
FIG. 13 is a perspective view illustrating an exemplary user support assembly from the front left side wherein an alternate embodiment leg exercise arm assembly is in a start position and an alternate embodiment wrist roller assembly is in a stored first position.
Figure 13:
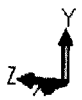
Figure 14:
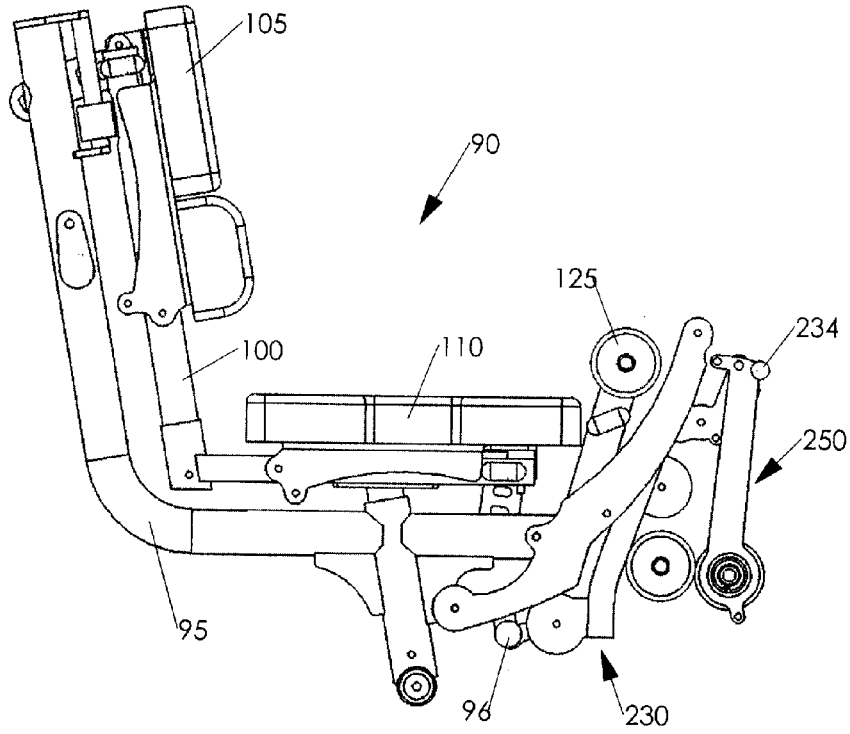
FIG. 14 is a side view illustrating an exemplary user support assembly wherein an alternate embodiment leg exercise arm assembly is in a start position and an alternate embodiment wrist roller assembly is in a stored first position.
Figure 14:
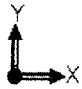

FIGS. 13 and 14 illustrate the user support assembly 90, an alternate embodiment leg exercise arm assembly 230 pivotally attached to the user support assembly 90, and an alternate embodiment wrist roller assembly 250 pivotally attached and locked into the leg exercise arm assembly 230 into a first position in storage.

Figure 15:
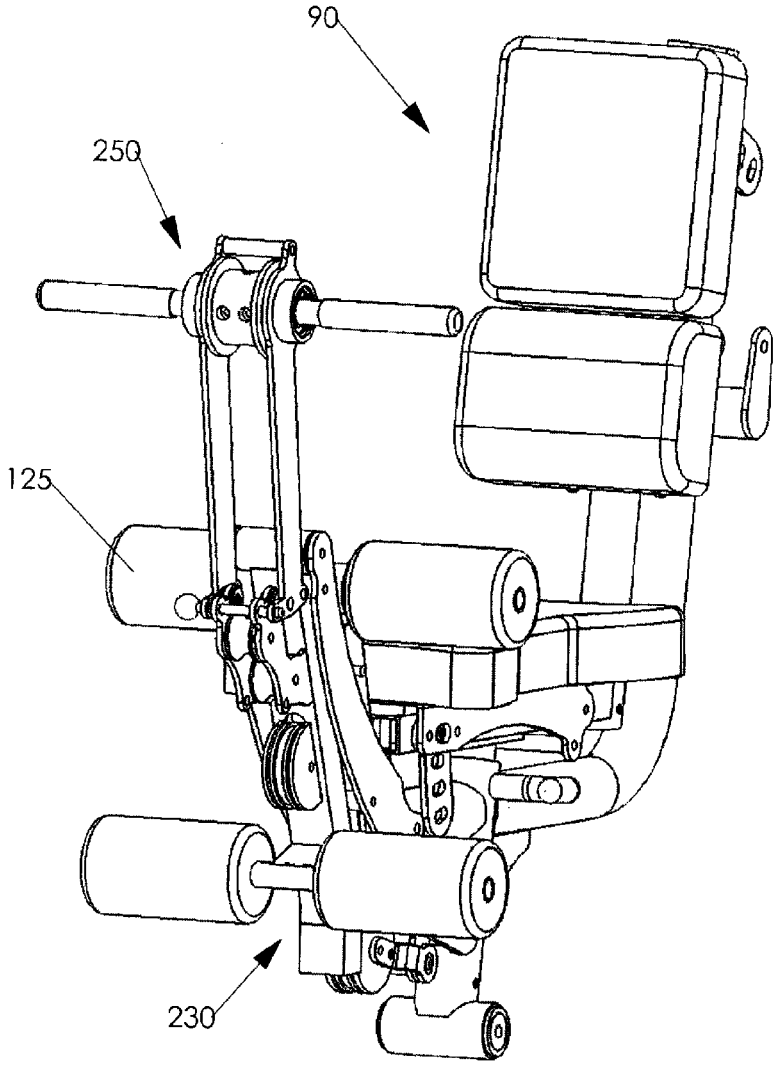
FIG. 15 is a perspective view illustrating an exemplary user support assembly from the front left side wherein an alternate embodiment leg exercise arm assembly is in a start position and an alternate embodiment wrist roller assembly is in a use second position.
Figure 15:
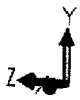
Figure 16:
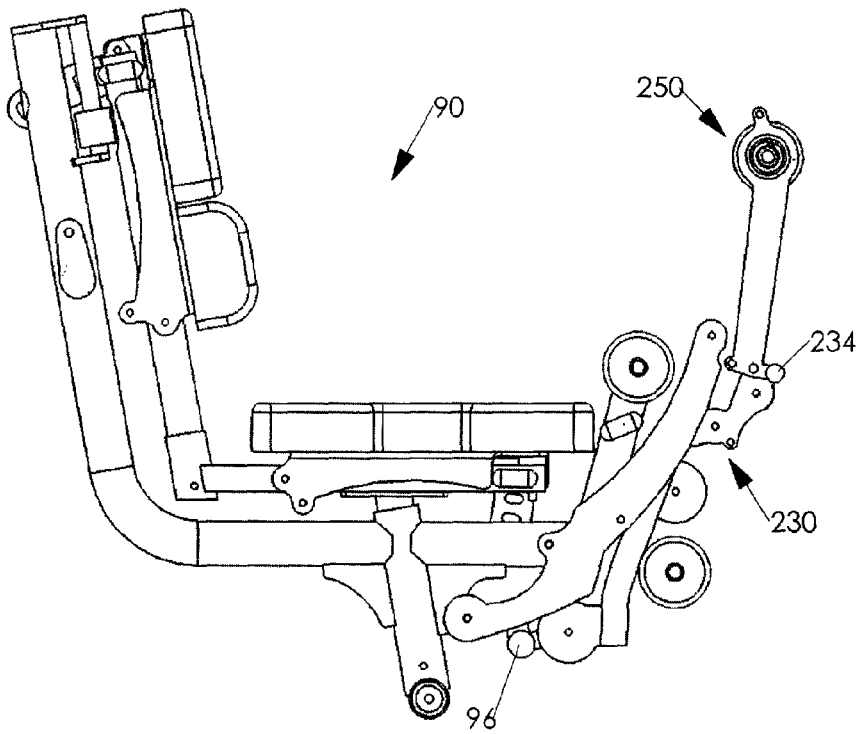
FIG. 16 is a side view illustrating an exemplary user support assembly wherein an alternate embodiment leg exercise arm assembly is in a start position and an alternate embodiment wrist roller assembly is in a use second position.
Figure 16:
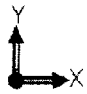

FIGS. 15 and 16 illustrate the user support assembly 90, an alternate embodiment leg exercise arm assembly 230 pivotally attached to the user support assembly 90, and an alternate embodiment wrist roller assembly 250 pivotally attached and locked into the leg exercise arm assembly 230 into a second position in use.

Figure 20:
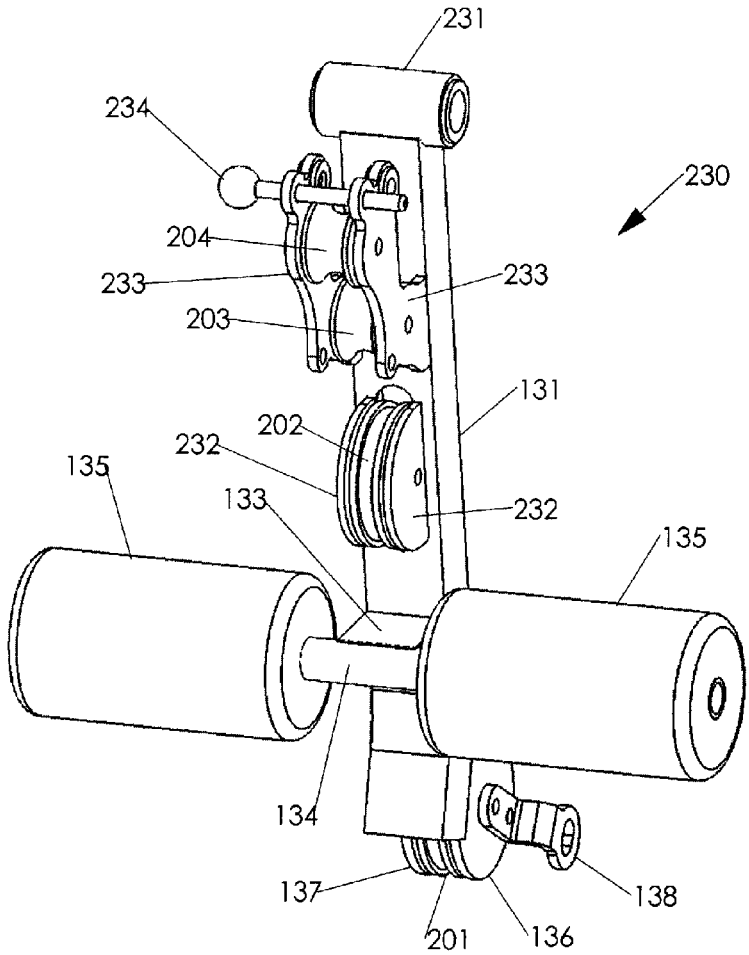
FIG. 20 is a perspective view illustrating an alternate embodiment leg exercise arm assembly from the front left side.
Figure 20:
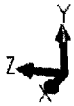

An alternate embodiment leg exercise arm 230 is illustrated in FIG. 20 and includes extension tube 131 wherein bushing tube 231 is attached at one end. Pulley plates 136 and 137 are attached near the opposite end and secure pulley 201 of cable and pulley system 200. Aperture plate 138 is attached to pulley plate 136 and as best illustrated in FIGS. 15 and 16, provides an aperture for locking pin 96 on seat main frame 95 to lock into to secure leg exercise arm 230 into a stationary position when leg extension or leg curl exercises are not being performed by a user. Locking pin 96 is adjusted to an unlocked position when leg extension and leg curl exercises are being performed.

Leg exercise arm 230 further includes pulley plates 232 which secure pulley 202 of cable and pulley system 200, and pulley plates 233 which secure pulleys 203 and 204 of cable and pulley system 200. Locking pin 234 goes through pulley plates 233 and secures wrist roller assembly 250 into a first position in storage as best illustrated in FIGS. 13 and 14 and into a second position in use as best illustrated in FIGS. 15 and 16. Lower pad extension tube 133 and lower pad tube 134 are attached to extension tube 131 and secure lower pads 135.

Figure 19:
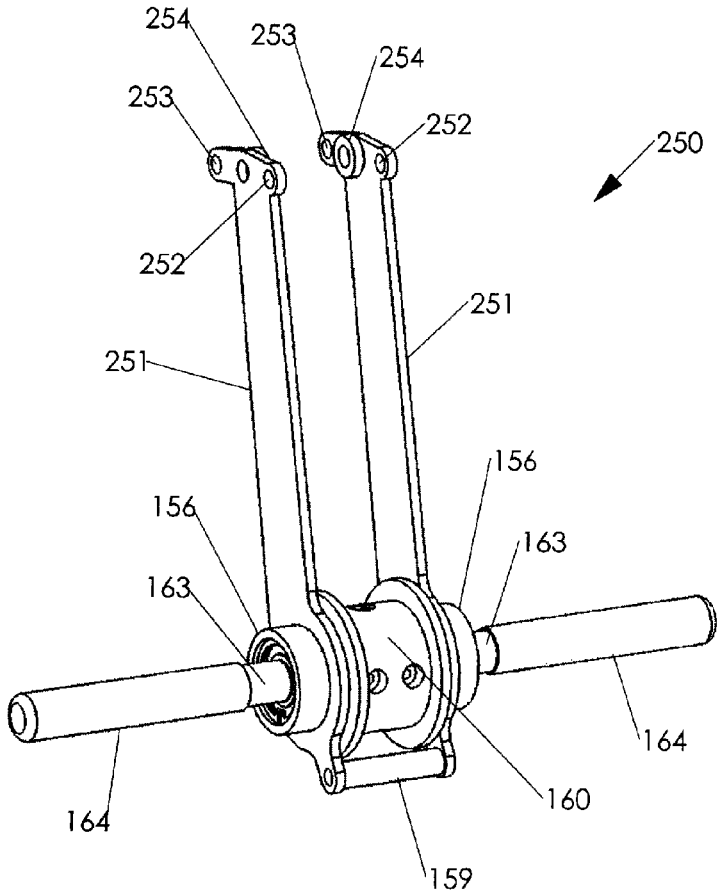
FIG. 19 is a perspective view illustrating an alternate embodiment wrist roller assembly from the front right side.
Figure 19:
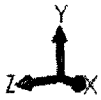

An alternate embodiment wrist roller assembly 250 is illustrated in FIG. 19 and includes side plates 251 wherein each side plate 251 includes a bushing 254 attached near one end and a bearing sleeve 156 attached near the other end. Bearing 157 fits into bearing sleeve 156 and is secured by snap ring 158. Aperture 252 in side plate 251 is used by locking pin 234 of leg exercise arm assembly 230 to secure wrist roller assembly 250 into a first position in storage and aperture 253 in side plate 251 is used by locking pin 234 of leg exercise arm assembly 230 to secure wrist roller assembly 250 into a second position in use. Spacer 159 attaches in between side plates 251 and provides proper spacing. Flexible line reel 160 fits in between side plates 251 and provides a surface for a flexible line to wrap around as wrist rolling exercises are being performed. Flexible line reel 160 also includes an aperture for a flexible line to go through wherein retainer 165 secures the flexible line. Respective handle bars 163 along with respective grips 164 go through respective bearings 157 of side plates 251, through respective bushings 162, and are secured inside of flexible line reel 160.

Figure 18:
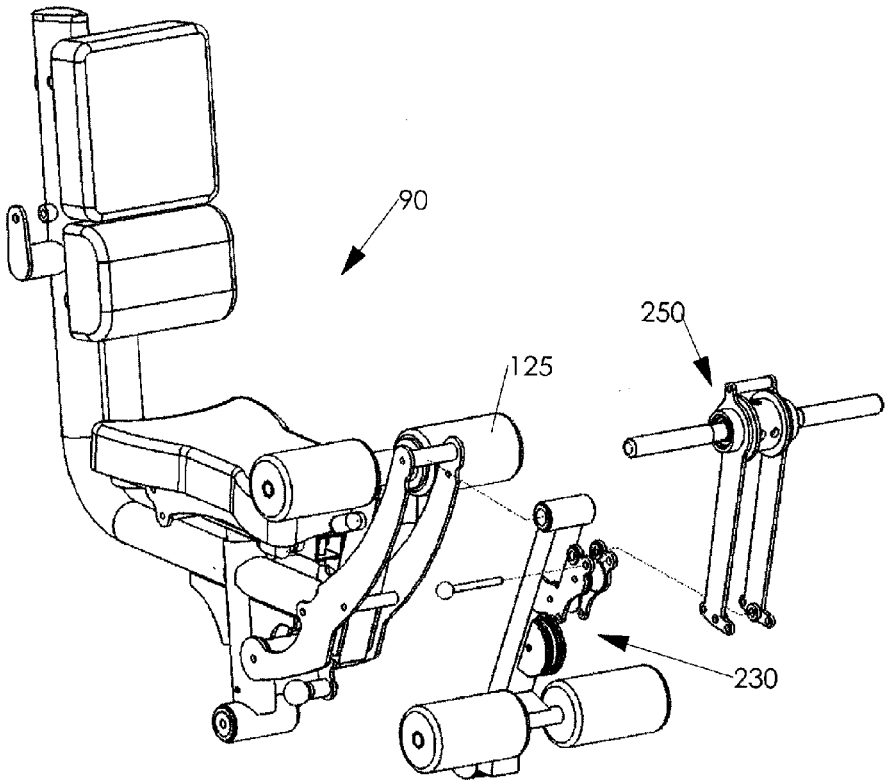
FIG. 18 is an exploded perspective view illustrating an exemplary user support assembly, an alternate embodiment leg exercise arm assembly, and an alternate embodiment wrist roller assembly from the front right side.
Figure 18:
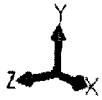

FIG. 18 is an exploded view illustrating the above mentioned alternate embodiment leg exercise arm assembly 230 and alternate embodiment wrist roller assembly 250 detached from the user support assembly 90.

Figure 21:
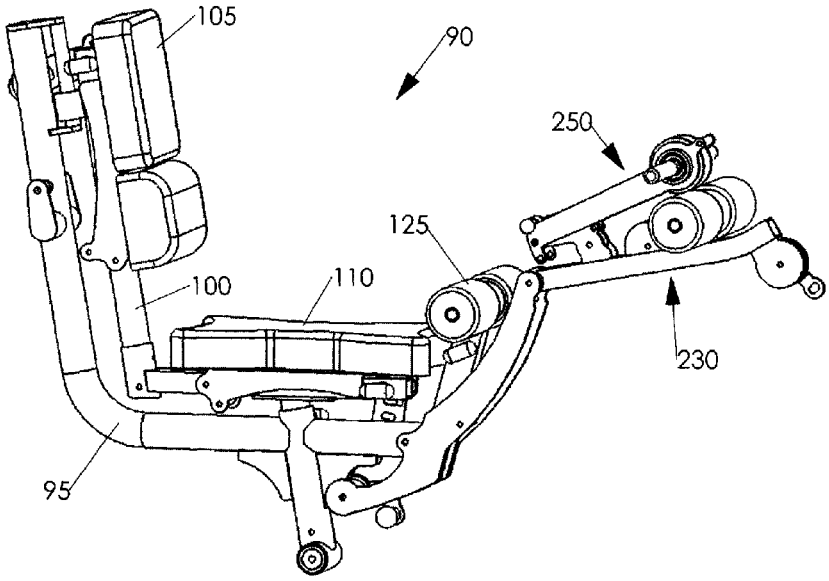
FIG. 21 is a perspective view illustrating an exemplary user support assembly from the front right side wherein an alternate embodiment leg exercise arm assembly is in a finish position and an alternate embodiment wrist roller assembly is in a stored first position.
Figure 21:
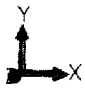

FIG. 21 illustrates user support assembly 90 wherein the wrist roller assembly 250 is in a locked first position in storage and wherein the leg exercise arm assembly 230 is in an extended finish position wherein a user would be performing a leg extension exercise. In this alternate embodiment, the leg exercise arm assembly 230 is pivotally attached to the user support assembly 90 and the wrist roller assembly 250 is pivotally attached to the leg exercise arm assembly 230, therefore the wrist roller assembly 250 moves along with leg exercise arm assembly 230 during leg extension exercises. To perform leg extension exercise, the user would select the desired amount of resistance from weight stack 30, sit on user seat support 90, place their legs just underneath their knees over upper pad assembly 125, and their lower legs near their ankles behind lower pads 135 of leg exercise arm assembly 230. The user would then extend their legs back and forth for the desired number of repetitions. The wrist roller assembly 250 in this locked first position in storage does not interfere with the user's legs or feet during leg extension exercises.

Figure 22:
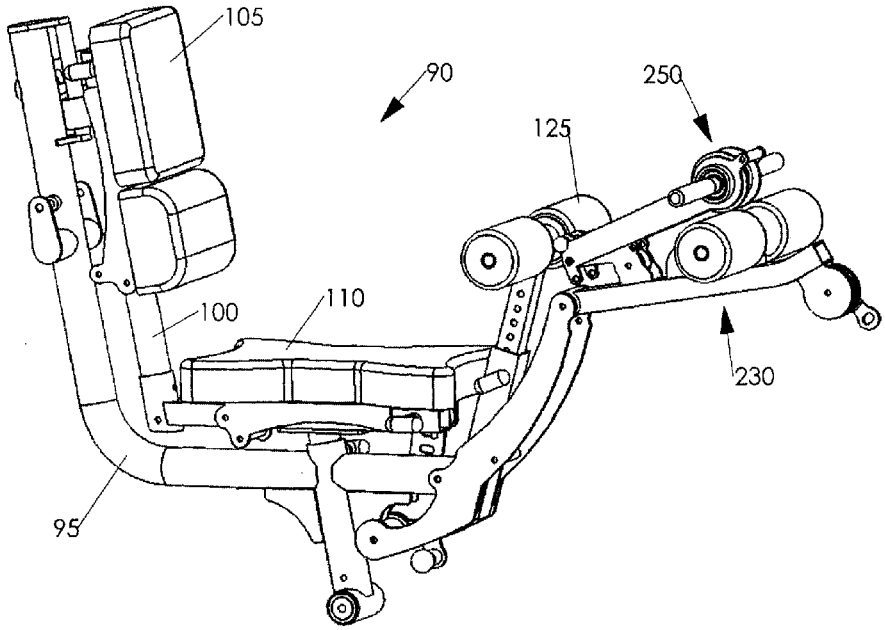
FIG. 22 is a perspective view illustrating an exemplary user support assembly from the front right side wherein an alternate embodiment leg exercise arm assembly is in a finish position and an alternate embodiment wrist roller assembly is in a stored first position.
Figure 22:
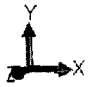

FIG. 22 illustrates user support assembly 90 wherein the wrist roller assembly 250 is in a locked first position in storage and wherein the leg exercise arm assembly 230 is in an extended finish position wherein a user would be performing a leg curl exercise. In this alternate embodiment, the leg exercise arm assembly 230 is pivotally attached to the user support assembly 90 and the wrist roller assembly 250 is pivotally attached to the leg exercise arm assembly 230, therefore the wrist roller assembly 250 moves along with leg exercise arm assembly 230 during leg curl exercises. To perform leg curl exercise, the user would select the desired amount of resistance from weight stack 30, stand in front facing user seat support 90, adjust the upper pad assembly 125 wherein the pads are above the pivot axis of leg exercise arm assembly 230, brace the front of one of their legs just above their knee against upper pad assembly 125, and brace the same leg near their ankle behind a respective lower pad 135 of leg exercise arm assembly 230. The user would then curl their leg back and forth for the desired number of repetitions. The wrist roller assembly 250 in this locked first position in storage does not interfere with the user's legs or feet during leg curl exercises.

FIGS. 15 and 16 illustrate user support assembly 90 wherein the wrist roller assembly 250 is in a locked second position in use. To perform wrist rolling exercise, the user would select the desired amount of resistance from weight stack 30. The user could sit on user support assembly 90 and be in a seated position to perform wrist rolling exercise or the user could straddle user support assembly 90 or stand in front of user support assembly 90 to perform wrist rolling exercise. Once the seated or standing position is selected, the user would then grasp grips 164 on handle bars 163 and then begin to roll their wrists forwards or backwards, thus rotating the flexible line reel 160 wherein a flexible line within flexible line connecting system 200 will wrap around flexible line reel 160 and displace weight stack 30. Once finished performing wrist rolling exercises, the user can unlock locking pin 234 of leg exercise arm assembly 230 and pivot wrist roller assembly 250 downward and lock it into the above described first position in storage wherein locking pin 234 of leg exercise arm assembly 230 secures wrist roller assembly 250 to the leg exercise arm assembly 230. When locked into the first position in storage, the wrist roller assembly 150 will not interfere with any other exercise movements or positions of the user on exercise apparatus 10.

Figure 17:
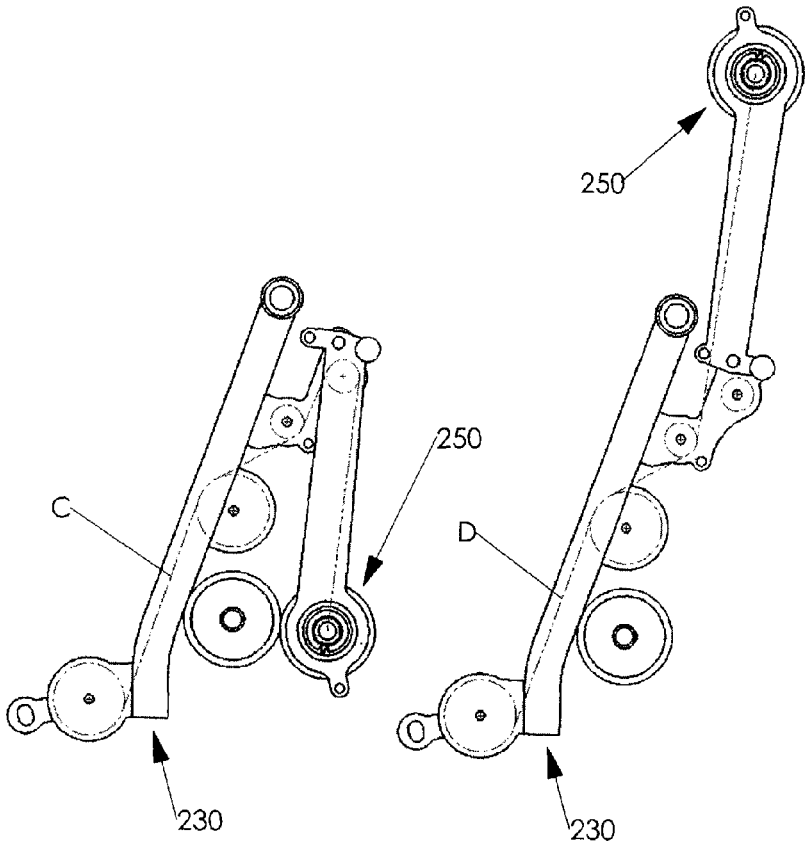
FIG. 17 is a side view illustrating the flexible line routing of an alternate embodiment leg exercise arm assembly in a start position and an alternate embodiment wrist roller assembly in a stored first position as well as a use second position.
Figure 17:
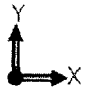

FIG. 17 illustrates a wrist roller assembly 250 pivotally attached to a leg exercise arm assembly 230 and locked into a first position in storage and a wrist roller assembly 250 pivotally attached to a leg exercise arm assembly 230 and locked into a second position in use. The flexible line routing is illustrated for both locked positions. The illustration of the flexible line routing wherein the wrist roller assembly 250 is locked into a first position in storage begins near the bottom of leg exercise arm assembly 230 with pulley 201 and is labeled with the letter C. The flexible line then travels upward and partially wraps over pulley 202. The flexible line then travels upward and partially wraps under pulley 203. The flexible line then travels upward and wraps over pulley 204 and then back downward and connects to wrist roller assembly 250.

The illustration of the flexible line routing wherein the wrist roller assembly 250 is locked into a second position in use begins near the bottom of leg exercise arm assembly 230 with pulley 201 and is labeled with the letter D. The flexible line then travels upward and partially wraps over pulley 202. The flexible line then travels upward and partially wraps under pulley 203. The flexible line continues to travel upward and connects to wrist roller assembly 250.

The portion of flexible line C that wraps partially around the circumference of pulley 204 when the wrist roller assembly 250 is locked in the first position in storage is equal to the offset height differential of the wrist roller assembly 250 pivot axis from pulley 204. Therefore, because flexible line D bypasses pulley 204 and is connected directly into wrist roller assembly 250 when the wrist roller assembly 250 is locked in the second position in use, the length of flexible line C is equal to the length of flexible line D. Since the portion of the flexible line interconnecting the leg exercise arm assembly 230 with the wrist roller assembly 250 maintains a substantially equal length whether the wrist roller assembly 250 is locked into a first position in storage or locked into a second position in use, the flexible line connecting system 200 will also maintain a substantially constant tension whether the wrist roller assembly 250 is locked into a first position in storage or locked into a second position in use.

Figure 23:
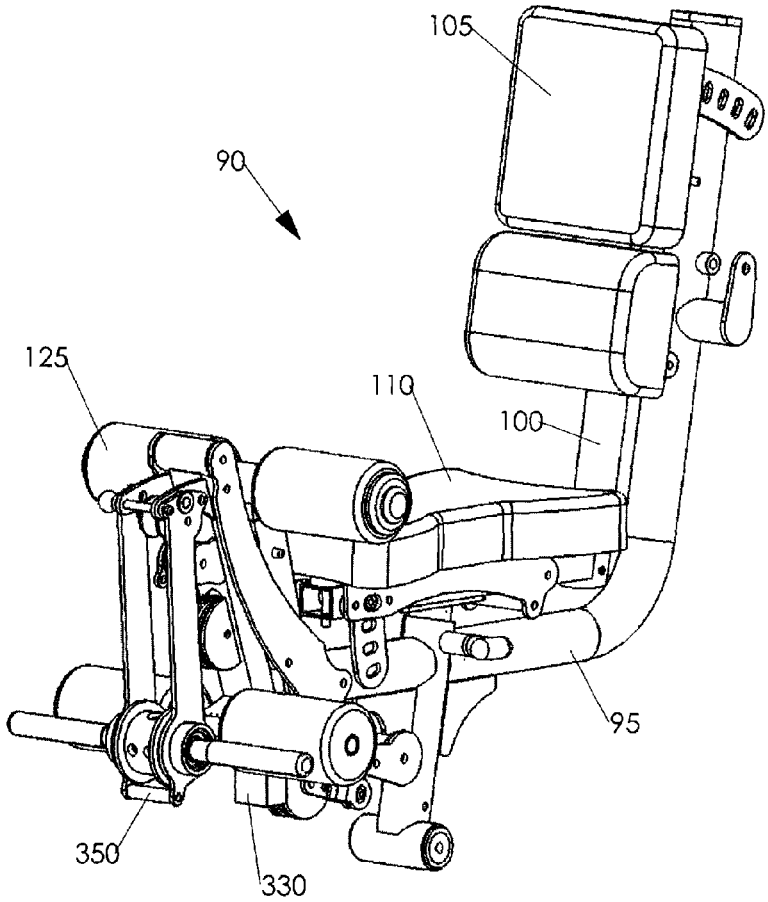
FIG. 23 is a perspective view illustrating an exemplary user support assembly from the front left side wherein a second alternate embodiment leg exercise arm assembly is in a start position and a second alternate embodiment wrist roller assembly is in a stored first position.
Figure 23:
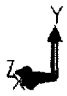
Figure 24:
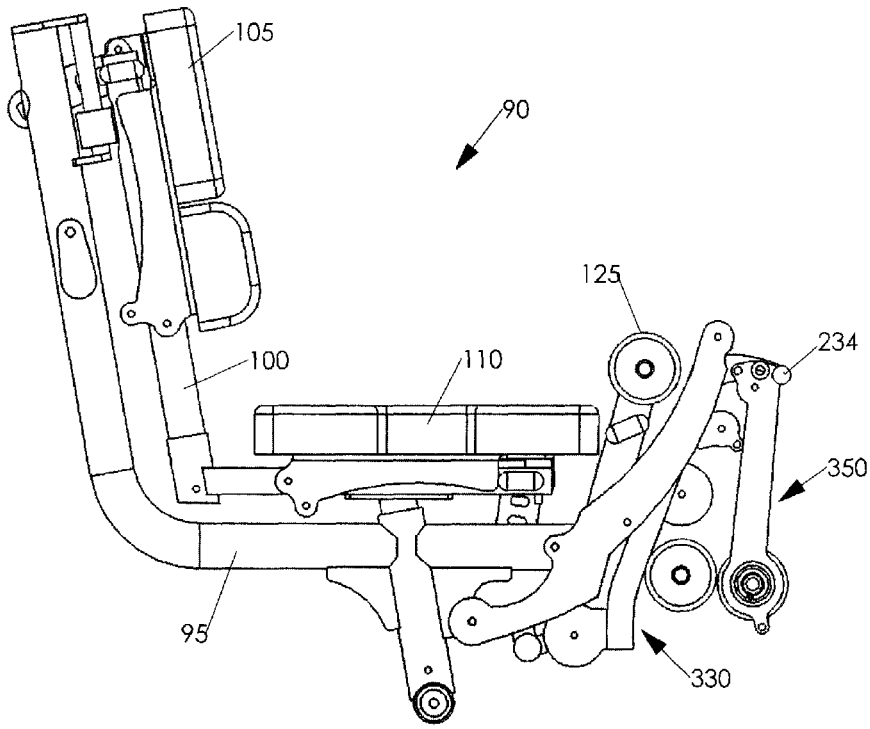
FIG. 24 is a side view illustrating an exemplary user support assembly wherein a second alternate embodiment leg exercise arm assembly is in a start position and a second alternate embodiment wrist roller assembly is in a stored first position.
Figure 24:
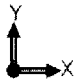

FIGS. 23 and 24 illustrate the user support assembly 90, an alternate embodiment leg exercise arm assembly 330 pivotally attached to the user support assembly 90, and an alternate embodiment wrist roller assembly 350 pivotally attached and locked into the leg exercise arm assembly 330 into a first position in storage.

Figure 25:
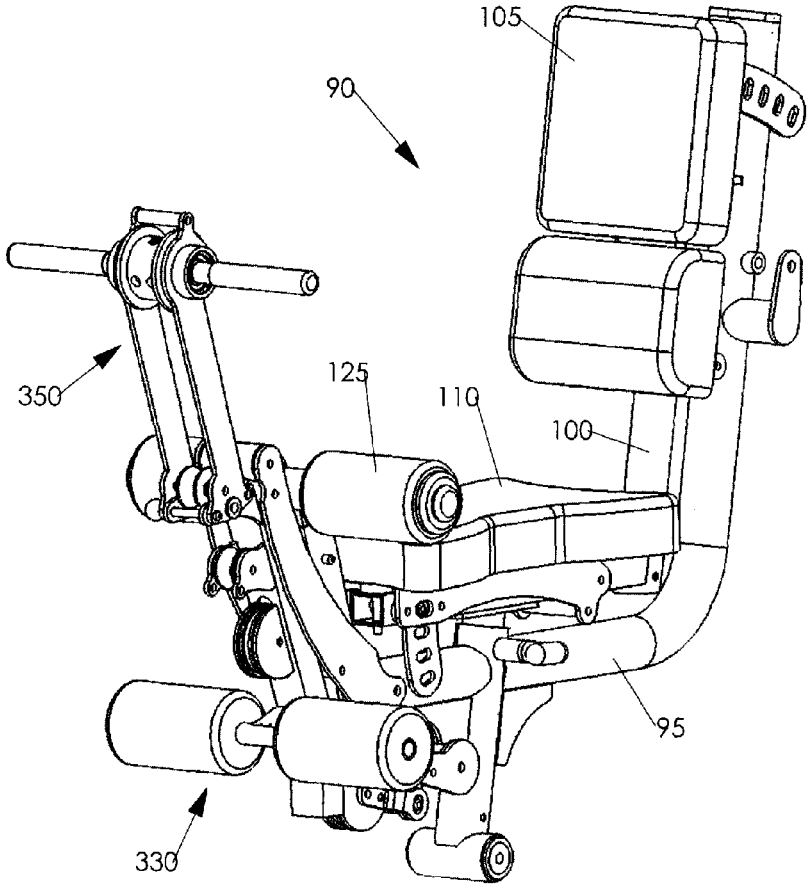
FIG. 25 is a perspective view illustrating an exemplary user support assembly from the front left side wherein a second alternate embodiment leg exercise arm assembly is in a start position and a second alternate embodiment wrist roller assembly is in a use second position.
Figure 25:
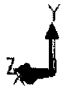
Figure 26:
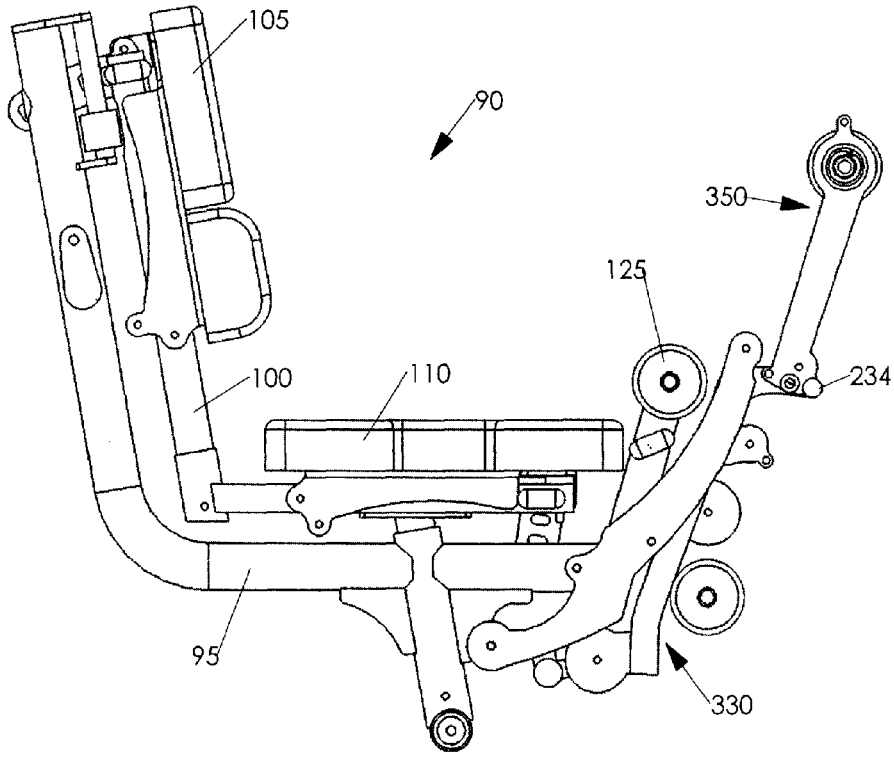
FIG. 26 is a side view illustrating an exemplary user support assembly wherein a second alternate embodiment leg exercise arm assembly is in a start position and a second alternate embodiment wrist roller assembly is in a use second position.
Figure 26:
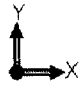

FIGS. 25 and 26 illustrate the user support assembly 90, an alternate embodiment leg exercise arm assembly 330 pivotally attached to the user support assembly 90, and an alternate embodiment wrist roller assembly 350 pivotally attached and locked into the leg exercise arm assembly 330 into a second position in use.

Figure 30:
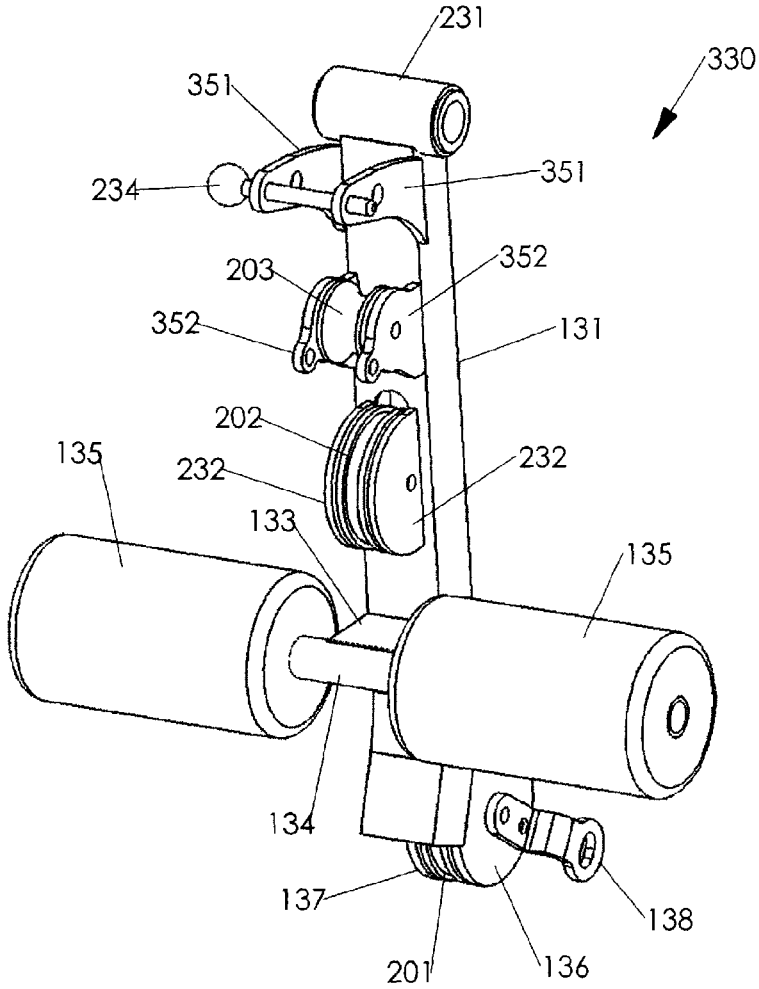
FIG. 30 is a perspective view illustrating a second alternate embodiment leg exercise arm assembly from the front left side.
Figure 30:
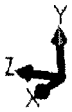

An alternate embodiment leg exercise arm 330 is illustrated in FIG. 30 and includes extension tube 131 wherein bushing tube 231 is attached at one end. Pulley plates 136 and 137 are attached near the opposite end and secure pulley 201 of cable and pulley system 200. Aperture plate 138 is attached to pulley plate 136 and as best illustrated in FIGS. 23 and 24, provides an aperture for locking pin 96 on seat main frame 95 to lock into to secure leg exercise arm 330 into a stationary position when leg extension or leg curl exercises are not being performed by a user. Locking pin 96 is adjusted to an unlocked position when leg extension and leg curl exercises are being performed.

Leg exercise arm 330 further includes pulley plates 232 which secure pulley 202 of cable and pulley system 200, and pulley plates 352 which secure pulley 203 of cable and pulley system 200. Axis plates 351 are attached near the top of extension tube 131 and provide a pivoting axis point for wrist roller assembly 350 to attach to. Locking pin 234 goes through axis plates 351 and secures wrist roller assembly 350 into a first position in storage as best illustrated in FIGS. 23 and 24 and into a second position in use as best illustrated in FIGS. 25 and 26. Lower pad extension tube 133 and lower pad tube 134 are attached to extension tube 131 and secure lower pads 135.

Figure 29:
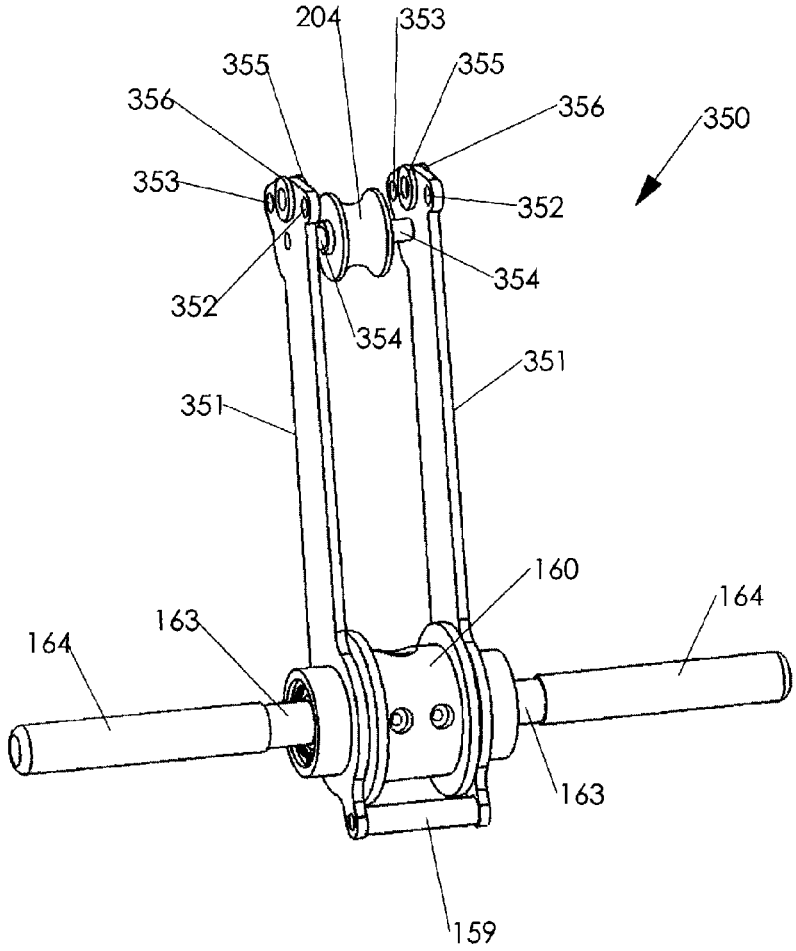
FIG. 29 is a perspective view illustrating a second alternate embodiment wrist roller assembly from the front right side.
Figure 29:
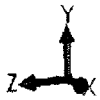

An alternate embodiment wrist roller assembly 350 is illustrated in FIG. 29 and includes side plates 351 wherein each side plate 251 includes bushings 355 and 356 attached near one end and a bearing sleeve 156 attached near the other end. Bearing 157 fits into bearing sleeve 156 and is secured by snap ring 158. Aperture 352 in side plate 351 is used by locking pin 234 of leg exercise arm assembly 330 to secure wrist roller assembly 350 into a first position in storage and aperture 353 in side plate 351 is used by locking pin 234 of leg exercise arm assembly 330 to secure wrist roller assembly 350 into a second position in use. Spacer 159 attaches in between side plates 351 and provides proper spacing. Flexible line reel 160 fits in between side plates 351 and provides a surface for a flexible line to wrap around as wrist rolling exercises are being performed. Flexible line reel 160 also includes an aperture for a flexible line to go through wherein retainer 165 secures the flexible line. Respective handle bars 163 along with respective grips 164 go through respective bearings 157 of side plates 351, through respective bushings 162, and are secured inside of flexible line reel 160. Pulley 204 of cable and pulley system 200 and spacers 354 are attached in between side plates 351 near the end where bushings 355 and 356 are attached.

Figure 28:
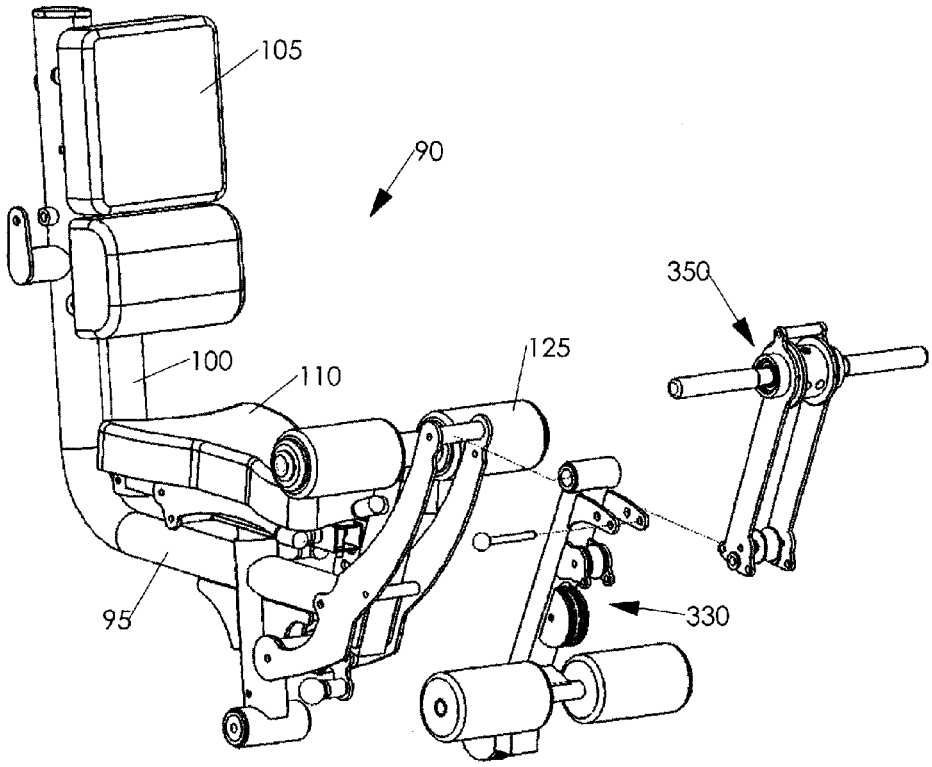
FIG. 28 is an exploded perspective view illustrating an exemplary user support assembly, a second alternate embodiment leg exercise arm assembly, and a second alternate embodiment wrist roller assembly from the front right side.
Figure 28:
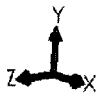

FIG. 28 is an exploded view illustrating the above mentioned alternate embodiment leg exercise arm assembly 330 and alternate embodiment wrist roller assembly 350 detached from the user support assembly 90.

Figure 31:
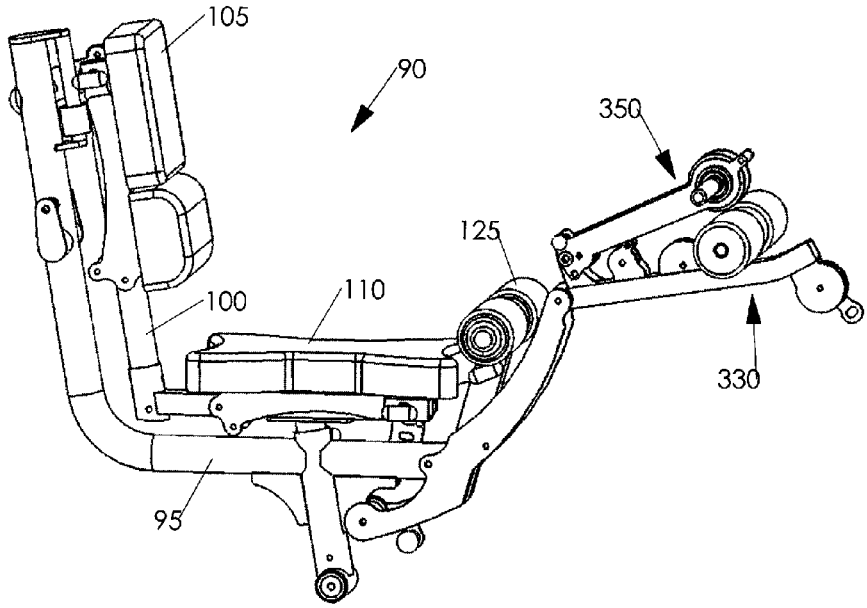
FIG. 31 is a perspective view illustrating an exemplary user support assembly from the front right side wherein a second alternate embodiment leg exercise arm assembly is in a finish position and second alternate embodiment wrist roller assembly is in a stored first position.
Figure 31:
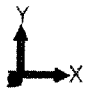

FIG. 31 illustrates user support assembly 90 wherein the wrist roller assembly 350 is in a locked first position in storage and wherein the leg exercise arm assembly 330 is in an extended finish position wherein a user would be performing a leg extension exercise. In this alternate embodiment, the leg exercise arm assembly 330 is pivotally attached to the user support assembly 90 and the wrist roller assembly 350 is pivotally attached to the leg exercise arm assembly 330, therefore the wrist roller assembly 350 moves along with leg exercise arm assembly 330 during leg extension exercises. To perform leg extension exercise, the user would select the desired amount of resistance from weight stack 30, sit on user seat support 90, place their legs just underneath their knees over upper pad assembly 125, and their lower legs near their ankles behind lower pads 135 of leg exercise arm assembly 330. The user would then extend their legs back and forth for the desired number of repetitions. The wrist roller assembly 350 in this locked first position in storage does not interfere with the user's legs or feet during leg extension exercises.

Figure 32:
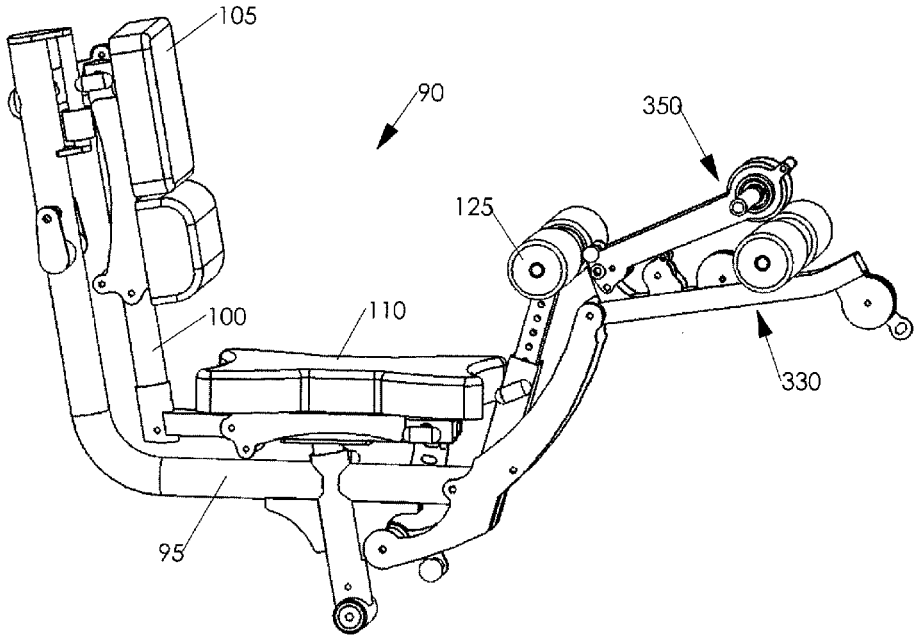
FIG. 32 is a perspective view illustrating an exemplary user support assembly from the front right side wherein a second alternate embodiment leg exercise arm assembly is in a finish position and a second alternate embodiment wrist roller assembly is in a stored first position.
Figure 32:
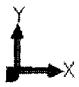

FIG. 32 illustrates user support assembly 90 wherein the wrist roller assembly 350 is in a locked first position in storage and wherein the leg exercise arm assembly 330 is in an extended finish position wherein a user would be performing a leg curl exercise. In this alternate embodiment, the leg exercise arm assembly 330 is pivotally attached to the user support assembly 90 and the wrist roller assembly 350 is pivotally attached to the leg exercise arm assembly 330, therefore the wrist roller assembly 350 moves along with leg exercise arm assembly 330 during leg curl exercises. To perform leg curl exercise, the user would select the desired amount of resistance from weight stack 30, stand in front facing user seat support 90, adjust the upper pad assembly 125 wherein the pads are above the pivot axis of leg exercise arm assembly 330, brace the front of one of their legs just above their knee against upper pad assembly 125, and brace the same leg near their ankle behind a respective lower pad 135 of leg exercise arm assembly 330. The user would then curl their leg back and forth for the desired number of repetitions. The wrist roller assembly 350 in this locked first position in storage does not interfere with the user's legs or feet during leg curl exercises.

FIGS. 25 and 26 illustrate user support assembly 90 wherein the wrist roller assembly 350 is in a locked second position in use. To perform wrist rolling exercise, the user would select the desired amount of resistance from weight stack 30. The user could sit on user support assembly 90 and be in a seated position to perform wrist rolling exercise or the user could straddle user support assembly 90 or stand in front of user support assembly 90 to perform wrist rolling exercise. Once the seated or standing position is selected, the user would then grasp grips 164 on handle bars 163 and then begin to roll their wrists forwards or backwards, thus rotating the flexible line reel 160 wherein a flexible line within flexible line connecting system 200 will wrap around flexible line reel 160 and displace weight stack 30. Once finished performing wrist rolling exercises, the user can unlock locking pin 234 of leg exercise arm assembly 330 and pivot wrist roller assembly 350 downward and lock it into the above described first position in storage wherein locking pin 234 of leg exercise arm assembly 330 secures wrist roller assembly 350 to the leg exercise arm assembly 330. When locked into the first position in storage, the wrist roller assembly 150 will not interfere with any other exercise movements or positions of the user on exercise apparatus 10.

Figure 27:
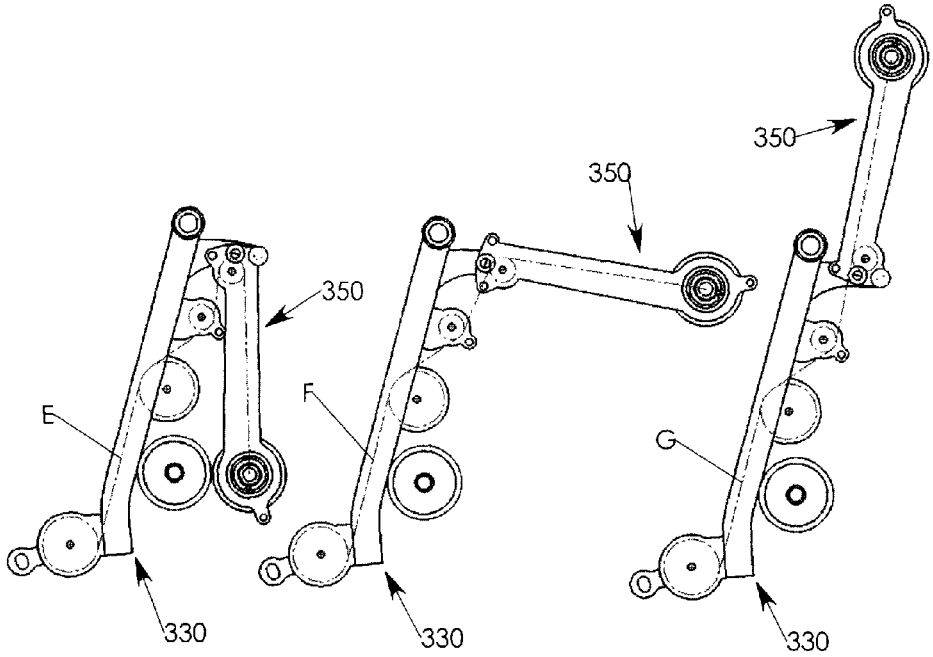
FIG. 27 is a side view illustrating the flexible line routing of a second alternate embodiment leg exercise arm assembly in a start position and a second alternate embodiment wrist roller assembly in a stored first position, a use second position, and a position along the adjustment path between the first and second position.
Figure 27:
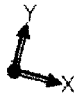

FIG. 27 illustrates a wrist roller assembly 350 pivotally attached to a leg exercise arm assembly 330 and locked into a first position in storage, a wrist roller assembly 350 pivotally attached to a leg exercise arm assembly 330 and locked into a second position in use, and a wrist roller assembly 350 in a position along the adjustment path between the first locked position and the second locked position. The flexible line routing is illustrated for both locked positions as well as a position along the adjustment path between the first locked position and the second locked position. The illustration of the flexible line routing wherein the wrist roller assembly 350 is locked into a first position in storage begins near the bottom of leg exercise arm assembly 330 with pulley 201 and is labeled with the letter E. The flexible line then travels upward and partially wraps over pulley 202. The flexible line then travels upward and partially wraps under pulley 203. The flexible line then travels upward and wraps over pulley 204, which is attached to wrist roller assembly 350, and then back downward and connects to wrist roller assembly 350.

The illustration of the flexible line routing wherein the wrist roller assembly 350 is locked into a second position in use begins near the bottom of leg exercise arm assembly 330 with pulley 201 and is labeled with the letter G. The flexible line then travels upward and partially wraps over pulley 202. The flexible line then travels upward and partially wraps under pulley 203. The flexible line continues to travel upward and connects to wrist roller assembly 350.

The portion of flexible line E that wraps partially around the circumference of pulley 204 when the wrist roller assembly 350 is locked in the first position in storage is equal to the offset height differential of the wrist roller assembly 350 pivot axis from pulley 204. Therefore, because flexible line G bypasses pulley 204 and is connected directly into wrist roller assembly 350 when the wrist roller assembly 350 is locked in the second position in use, the length of flexible line E is equal to the length of flexible line G. Since the portion of the flexible line interconnecting the leg exercise arm assembly 330 with the wrist roller assembly 350 maintains a substantially equal length whether the wrist roller assembly 350 is locked into a first position in storage or locked into a second position in use, the flexible line connecting system 200 will also maintain a substantially constant tension whether the wrist roller assembly 350 is locked into a first position in storage or locked into a second position in use.

The illustration of the flexible line routing wherein the wrist roller assembly 350 is in a position along the adjustment path between the first locked position and the second locked position begins near the bottom of leg exercise arm assembly 330 with pulley 201 and is labeled with the letter F. The flexible line then travels upward and partially wraps over pulley 202. The flexible line then travels upward and partially wraps under pulley 203. The flexible line continues to travel upward and wraps partially over the circumference of pulley 204, which is attached to wrist roller assembly 350, and then connects to wrist roller assembly 350. Since pulley 204 is attached to the wrist roller assembly 350, the offset height differential of the wrist roller assembly 350 pivot axis from pulley 204 and portion of flexible line F that wraps partially around the circumference of pulley 204 will constantly change and offset one another when the wrist roller assembly 350 pivots from one locked position to another. Therefore, the portion of the flexible line interconnecting the leg exercise arm assembly 330 with the wrist roller assembly 350 will maintain a substantially equal length whether the wrist roller assembly 350 is locked into a first position in storage, locked into a second position in use, or any position in between. Therefore, the flexible line connecting system 200 will also maintain a substantially constant tension whether the wrist roller assembly 350 is locked into a first position in storage, locked into a second position in use, or being pivotally adjusted from one locked position to another.

Those skilled in the art would appreciate that the components within the above mentioned embodiments could be mixed with one another to create other alternate embodiments. The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

The invention claimed is:

1. An exercise apparatus comprising:

a frame;

at least one resistance element to provide resistance for performing exercise;

a leg exercise arm assembly, for performing at least one leg exercise, pivotally attached to said frame;

a wrist roller assembly, including a rotatable handle bar assembly for performing forearm exercise, pivotally attached to said frame or to said leg exercise arm assembly and movable between a first position engaged with said leg exercise arm and a second position engaged with said frame or said leg exercise arm assembly; and a flexible line interconnecting said leg exercise arm assembly with said wrist roller assembly wherein said flexible line connects said leg exercise arm assembly and said wrist roller assembly directly or indirectly with said resistance element, wherein one end of said flexible line ties off onto said handle bar assembly, and wherein rotating said rotatable handle bar assembly will wrap said flexible line around said rotatable handle bar assembly, thus displacing said at least one resistance element.

2. The exercise apparatus of claim 1 further comprising a user support assembly attached to said frame to support a user during exercise, wherein said leg exercise arm assembly and said wrist roller assembly are pivotally attached in front of said user support assembly.

3. The exercise apparatus of claim 2 wherein said leg exercise arm assembly and said wrist roller assembly are pivotally attached to said frame about the same axis.

4. The exercise apparatus of claim 3 wherein said wrist roller assembly is movable between a first position engaged with said leg exercise arm assembly and a second position engaged with said frame.

5. The exercise apparatus of claim 4 wherein said rotatable handle bar assembly is positioned below said axis when said wrist roller assembly is in said first position engaged with said leg exercise arm assembly and positioned above said axis when said wrist roller assembly is in said second position engaged with said frame.

6. The exercise apparatus of claim 5 wherein said flexible line is partially routed around at least two pulleys mounted on said leg exercise arm assembly and maintains a substantially constant tension whether the wrist roller assembly is engaged in said first position or engaged in said second position.

7. The exercise apparatus of claim 4 wherein said leg exercise arm assembly and said wrist roller assembly pivot together during leg extension exercises when said wrist roller assembly is engaged in said first position.

8. The exercise apparatus of claim 4 wherein said leg exercise arm assembly and said wrist roller assembly pivot together during standing leg curl exercises when said wrist roller assembly is engaged in said first position.

9. The exercise apparatus of claim 4 wherein said wrist roller assembly, in the second position, is positioned to serve as a brace to help to stabilize a user while performing standing leg curl exercises.

10. The exercise apparatus of claim 1 wherein said wrist roller assembly is pivotally attached to said leg exercise arm assembly and is movable between a first position engaged with said leg exercise arm assembly and a second position engaged with said leg exercise arm assembly.

11. An exercise apparatus comprising:

a frame;

at least one resistance element to provide resistance for performing exercise;

a user support assembly, for supporting a user during exercise, pivotally attached to said frame;

a leg exercise arm assembly, for performing at least one leg exercise, pivotally attached to said user support assembly;

a wrist roller assembly, including a rotatable handle bar assembly for performing forearm exercise, pivotally attached to said user support assembly or to said leg exercise arm assembly and movable between a first position engaged with said leg exercise arm and a second position engaged with said user support assembly or said leg exercise arm assembly; and a flexible line interconnecting said leg exercise arm assembly with said wrist roller assembly wherein said flexible line connects said leg exercise arm assembly and said wrist roller assembly directly or indirectly with said resistance element, wherein one end of said flexible line ties off onto said handle bar assembly, and wherein rotating said rotatable handle bar assembly will wrap said flexible line around said rotatable handle bar assembly, thus displacing said at least one resistance element.

12. The exercise apparatus of claim 11 wherein said leg exercise arm assembly and said wrist roller assembly are pivotally attached to said user support assembly about the same axis.

13. The exercise apparatus of claim 12 wherein said wrist roller assembly is movable between a first position engaged with said leg exercise arm and a second position engaged with said user support assembly.

14. The exercise apparatus of claim 13 wherein said rotatable handle bar assembly is positioned below said axis when said wrist roller assembly is in said first position engaged with said leg exercise arm assembly and positioned above said axis when said wrist roller assembly is in said second position engaged with said user support assembly.

15. The exercise apparatus of claim 14 wherein said flexible line is partially routed around at least two pulleys mounted on said leg exercise arm assembly and maintains a substantially constant tension whether the wrist roller assembly is engaged in said first position or said second position.

16. The exercise apparatus of claim 13 wherein said leg exercise arm assembly and said wrist roller assembly pivot together during leg extension exercises when said wrist roller assembly is engaged in said first position.

17. The exercise apparatus of claim 13 wherein said leg exercise arm assembly and said wrist roller assembly pivot together during standing leg curl exercises when said wrist roller assembly is engaged in said first position.

18. The exercise apparatus of claim 13 wherein said wrist roller assembly, in the second position, is positioned to serve as a brace to help to stabilize a user while performing standing leg curl exercises.

19. The exercise apparatus of claim 11 wherein said wrist roller assembly is pivotally attached to said leg exercise arm assembly and is movable between a first position engaged with said leg exercise arm assembly and a second position engaged with said leg exercise arm assembly.

20. An exercise apparatus comprising:

a frame;

at least one resistance element to provide resistance for performing exercise;

a leg exercise arm assembly, for performing at least one leg exercise, mounted for pivotal movement;

a rotatable handle bar assembly, for performing forearm exercise, mounted to said leg exercise arm assembly;

at least one pulley mounted to said leg exercise arm assembly; and a flexible line partially routed around said pulley, wherein one end of said flexible line ties off onto said handle bar assembly, wherein the other end of said flexible line connects said leg exercise arm assembly and said handle bar assembly directly or indirectly with said resistance element, and wherein rotating said rotatable handle bar assembly will wrap said flexible line around said rotatable handle bar assembly, thus displacing said at least one resistance element.

* * * * *